US006035159A

United States Patent [19]

Azuma et al.

[11] Patent Number: 6,035,159

[45] **Date of Patent: *Mar. 7, 2000**

[54] PROCESS CARTRIDGE WITH AXIALLY SHIFTABLE DRIVE COUPLING

[75] Inventors: Jun Azuma, Kashiwa; Takashi Goto, Zushi; Masaaki Nishikawa, Kashiwa; Shigeo Murayama, Abiko, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,050

[22] Filed: Sep. 22, 1997

[30] Foreign Application Priority Data

Sep. 26, 1996 [JP] Japan ..... 8-277526

[51] Int. Cl.[7] ..... G03G 15/00; G03G 21/18

[52] U.S. Cl. ..... 399/111; 399/167

[58] Field of Search ..... 399/111, 117, 399/167

[56] References Cited

U.S. PATENT DOCUMENTS

| | | | |
|---|---|---|---|
| 4,829,335 | 5/1989 | Kanemitsu et al. | 399/111 |
| 5,023,660 | 6/1991 | Ebata et al. | 399/111 |
| 5,559,581 | 9/1996 | Suguira et al. | 399/111 |
| 5,561,496 | 10/1996 | Suguira et al. | 399/107 |
| 5,634,178 | 5/1997 | Suguira et al. | 399/110 |
| 5,903,803 | 5/1999 | Kawai et al. | 399/116 |

FOREIGN PATENT DOCUMENTS

| | | |
|---|---|---|
| 0 098 777 | 1/1984 | European Pat. Off. . |
| 4-24656 | 1/1992 | Japan . |
| 5-224475 | 9/1993 | Japan . |
| 2 141 520 | 12/1984 | United Kingdom . |

OTHER PUBLICATIONS

Patent Abstracts of Japan, vol. 014, No. 563, Dec. 14, 1990, Abstract of Jap. Pat. 02–240411 pub'd Sep. 25 1990.

Patent Abstracts of Japan, vol. 013, No. 153, Apr. 13, 1989, Abstract of Jap. Pat. 63–312516 pub'd Dec. 21 1998.

*Primary Examiner*—Joan Pendegrass

*Attorney, Agent, or Firm*—Fitzpatrick, Cella, Harper & Scinto

[57] ABSTRACT

An electrophotographic image forming apparatus which forms an image on a recording medium and to which a process cartridge can detachably be mounted includes (a) a cartridge mounting portion capable of detachably mounting a process cartridge including an electrophotographic photosensitive drum, a process device acting on the photosensitive drum, and a projection having a first-twisted-polygonal prism shape provided on one longitudinal end of the photosensitive drum, (b) a rotatable rotary member having a first twisted hole of polygonal cross-section, (c) a rotatable coupling shaft supported for axial movement and being provided at its one end with a second-twisted-polygonal prism shape fitted into the first twisted hole of the rotary member, and being provided at its other end with a second twisted hole of polygonal cross-section for engaging with and disengaging from the projection having the first-twisted-polygonal prism shape and having substantially the same twisted angle and twisted direction as those of the first-twisted-polygonal prism shape, (d) a spring member for biasing the coupling shaft toward the photosensitive drum, (e) an axial direction shifter for shifting the second twisted hole and the projection having the first-twisted-polygonal prism shape relative to each other between a first position and a second position, and (f) a conveyor for conveying the recording medium.

29 Claims, 13 Drawing Sheets

PROCESS CARTRIDGE WITH AXIALLY SHIFTABLE DRIVE COUPLING

BACKGROUND OF THE INVENTION

1. Field of the Invention

The present invention relates to a process cartridge and an electrophotographic image forming apparatus. Here, the electrophotographic image forming apparatus forms an image on a recording material using an electrophotographic image formation process. Examples of the electrophotographic image forming apparatus includes an electrophotographic copying machine, an electrophotographic printer (laser beam printer, LED printer or the like), a facsimile machine and a word processor or the like.

2. Related Background Art

The process cartridge contains integrally an electrophotographic photosensitive member and charging means, developing means or cleaning means, and is detachably mountable relative to a main assembly of the image forming apparatus. It may integrally contain the electrophotographic photosensitive member and at least one of the charging means, the developing means and the cleaning means. As another example, it may contain the electrophotographic photosensitive member and at least the developing means.

In an electrophotographic image forming apparatus using an electrophotographic image forming process, the process cartridge is used, which contains the electrophotographic photosensitive member and process means actable on said electrophotographic photosensitive member, and which is detachably mountable as a unit to a main assembly of the image forming apparatus (process cartridge type). With this process cartridge type, the maintenance of the apparatus can be carried out in effect by the user without depending on a serviceman. Therefore, the process cartridge type is now widely used in electrophotographic image forming apparatuses.

The present invention is directed to a further improvement of such a process cartridge.

A driving system for a photosensitive member in a process cartridge type, is disclosed in U.S. Pat. Nos. 4,829,335 and 5,023,660. A method of mounting a photosensitive drum is disclosed in U.S. Pat. No. 4,575,211.

SUMMARY OF THE INVENTION

An object of the present invention is to provide a process cartridge and an electrophotographic image forming apparatus, in which the rotating accuracy of an electrophotographic photosensitive drum can be improved.

Another object of the present invention is to provide a process cartridge and an electrophotographic image forming apparatus, in which, when a driving force is transmitted, positioning accuracy of an electrophotographic photosensitive drum with respect to a main assembly of the image forming apparatus can be improved by generating a biasing force directing toward a longitudinal direction and by biasing the photosensitive drum by the biasing force.

The other object of the present invention is to provide an electrophotographic image forming apparatus having a coupling system which does not act to transmit a rotational force to a drive side and a driven side when coupling between a main assembly coupling of a main assembly of the image forming apparatus and a cartridge coupling of a process cartridge is released.

DETAILED EXPLANATION OF THE PREFERRED EMBODIMENTS

The present invention will now be explained in connection with embodiment thereof with reference to the accompanying drawings.

In this specification, the word "longitudinal direction" is referred to as a direction which is perpendicular to a recording medium conveying direction along a surface of the recording medium and coincides with an axial direction of a photosensitive drum.

First Embodiment

First of all, a process cartridge B according to a first embodiment of the present invention and an electrophotographic image forming apparatus A to which such a process cartridge can detachably be mounted will be fully explained with reference to FIGS. 1 to 6. Thereafter, a shaft coupling (coupling) as a driving force transmitting mechanism between the process cartridge B and a main assembly 13 of the image forming apparatus will be explained with reference to FIGS. 7 to 13.

<Entire Construction>

Figure 1:
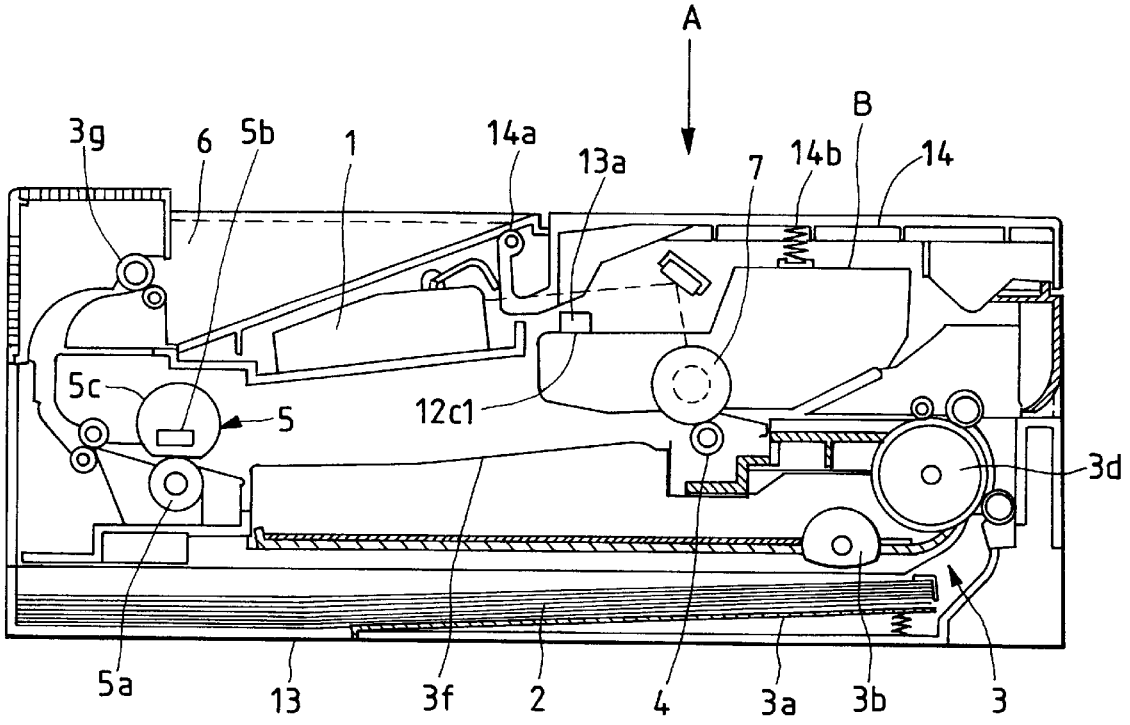
FIG. 1 is an elevational sectional view of an electrophotographic image forming apparatus according to a first embodiment of the present invention.

FIG. 1 is a sectional view for explaining a laser beam printer as an electrophotographic image forming apparatus A to which a process cartridge B is detachably mounted.

As shown in FIG. 1, in the printer A, a latent image is formed on a photosensitive drum 7 by illuminating laser light emitted from an optical system 1 in response to image information onto the photosensitive drum 7, and the latent image is developed by toner as a toner image. In synchronism with formation of the toner image, a recording medium 2 is conveyed from a sheet supply cassette 3*a* by means of a convey means 3 including a pick-up roller 3*b*, a pair of convey rollers 3*d* and the like. The toner image formed on the photosensitive drum 7 is transferred onto the recording medium 2 by applying voltage to a transfer roller (transfer means) 4. Then, the recording medium 2 is sent to a fixing means 5 through a guide plate 3*f*. The fixing means 5 comprises a drive roller 5*a* and a fixing rotary band 5*c* within which a heater 5*b* is disposed. While the recording medium 2 is being passed through the fixing means, the toner image is fixed to the recording medium 2 by applying heat and pressure to the recording medium. Thereafter, the recording medium 2 is discharged onto a discharge portion 6 by a pair of discharge rollers 3*g* through a reverse rotation convey path. Incidentally, in this printer A, a recording medium can be supplied manually through a manual insertion tray and a roller (an explanation thereof will be omitted).

On the other hand, the process cartridge B includes the electrophotographic photosensitive drum, and at least one process means. The process means may include, for example, a charge means for charging the electrophotographic photosensitive drum, a developing means for developing the latent image formed on the electrophotographic photosensitive drum, and a cleaning means for removing residual toner remaining on the electrophotographic photosensitive drum.

Figure 2:
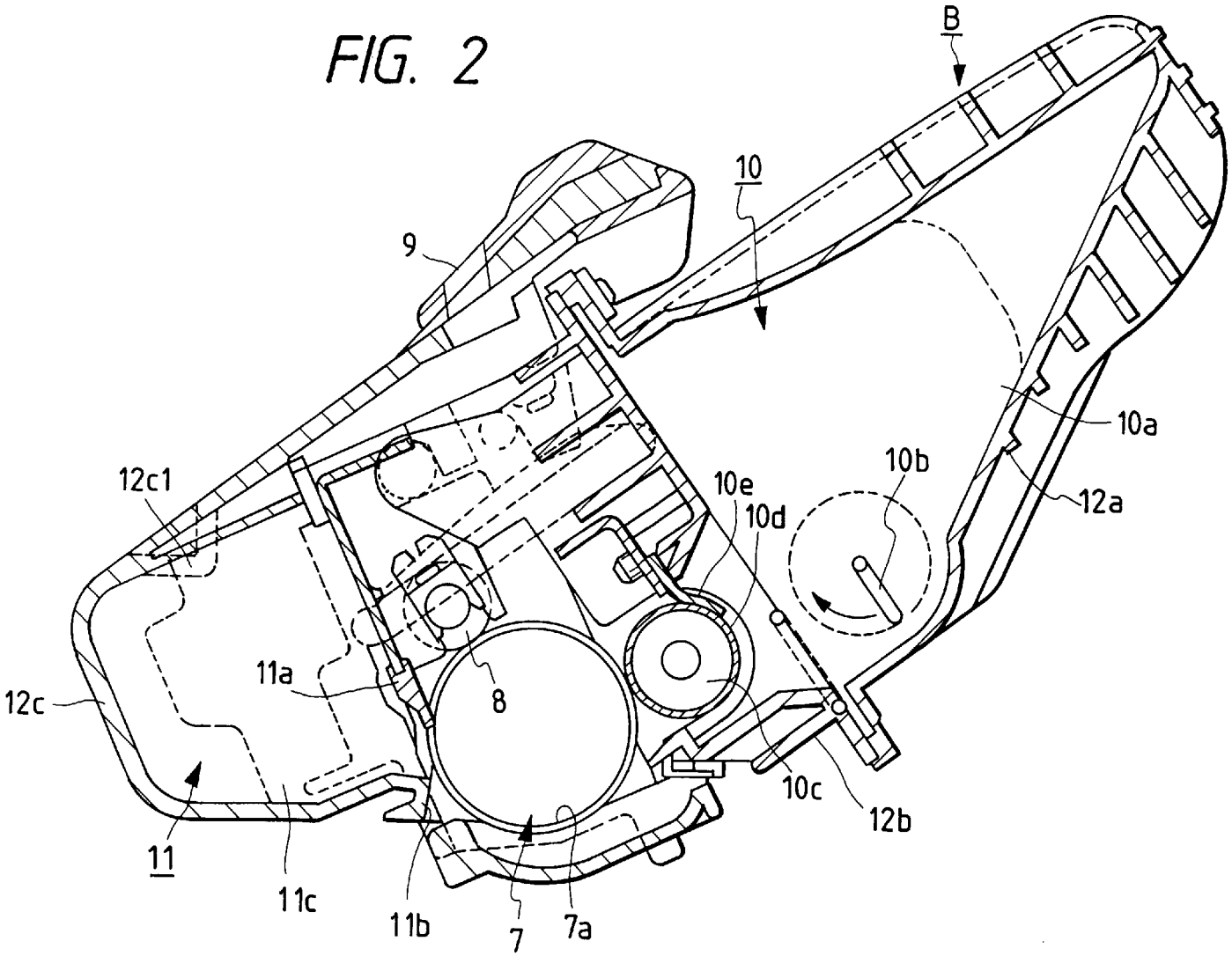
FIG. 2 is a sectional view of a process cartridge.

As shown in FIGS. 1 and 2, the process cartridge B according to the illustrated embodiment includes the electrophotographic photosensitive drum 7, a charge roller 8, an exposure opening 9, a developing means 10 and a cleaning means 11. In the process cartridge B, the photosensitive drum 7 is rotated by a driving force from a main assembly 13 of the printer through a coupling apparatus which will be described later. While the photosensitive drum is being rotated, the photosensitive drum is uniformly charged by applying voltage to the charge roller (charge means) 8, and the latent image is formed on the photosensitive drum 7 by illuminating information light (laser light) from the optical system 1 onto the photosensitive drum 7 through the exposure opening 9. Then, the latent image is developed by the developing means 10.

In the developing means 10, toner in a toner containing portion 10*a* is fed out by a toner feed member 10*b*, and the fed toner is supplied to a rotating developing roller 10*d* including a fixed magnet 10*c* therein. A toner layer is formed on the developing roller 10*d* by applying friction charges to the toner by means of a developing blade 10*e*, and the toner image is formed by transferring the toner in the toner layer onto the latent image formed on the photosensitive drum 7. The toner image is transferred onto the recording medium 2 by applying voltage to the transfer roller 4 provided in the main assembly 13 of the printer. Residual toner remaining on the photosensitive drum 7 is removed by the cleaning means 11. More specifically, the residual toner is scraped from the photosensitive drum by a cleaning blade 11*a*, and the scraped toner is collected into a waste toner reservoir 11*c* by a dip sheet 11*b*.

The charge roller 8 is urged against the photosensitive drum 7 and is driven by rotation of the photosensitive drum 7. The cleaning blade 11*a* is also urged against the photosensitive drum 7.

Figure 3:
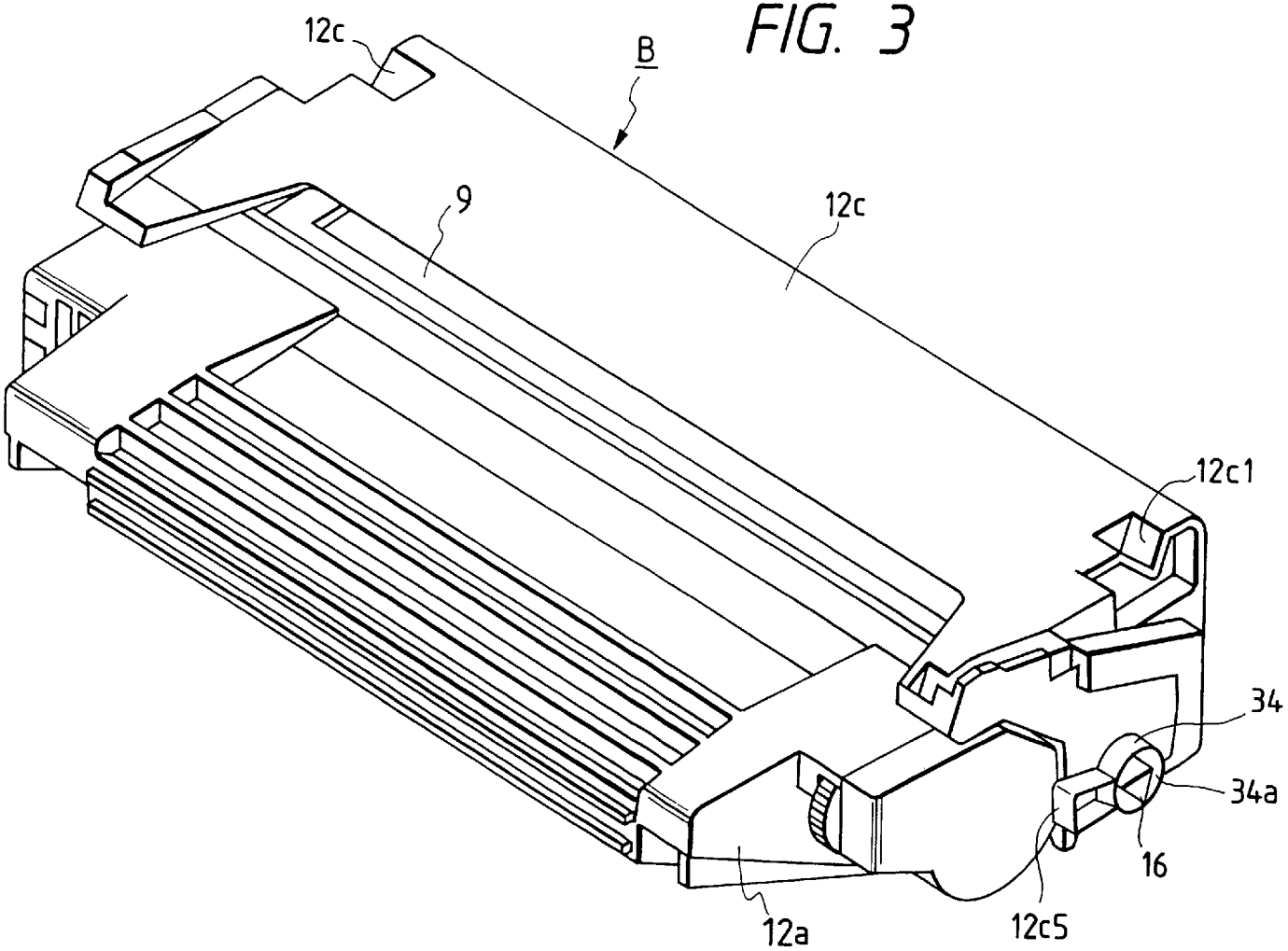
FIG. 3 is a perspective view of the process cartridge looked at from the right in a process cartridge mounting direction.
Figure 4:
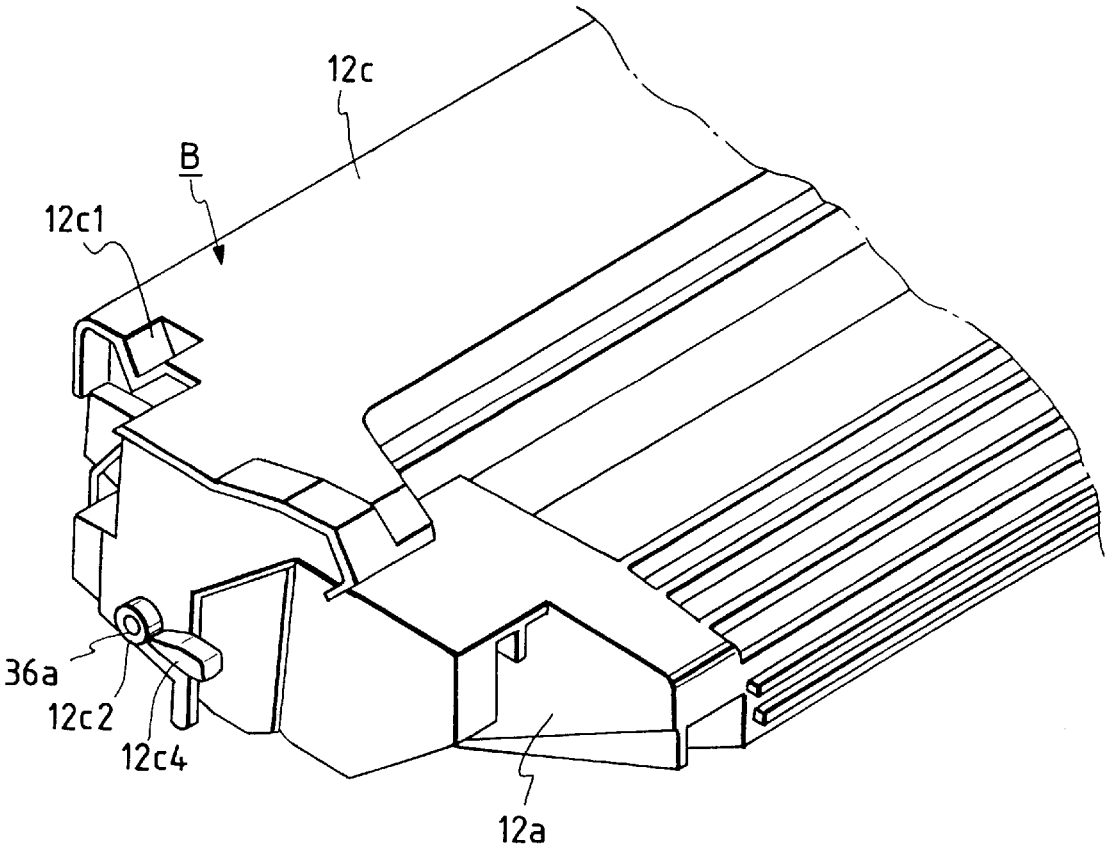
FIG. 4 is a perspective view of the process cartridge looked at from the left in the process cartridge mounting direction.
Figure 5:
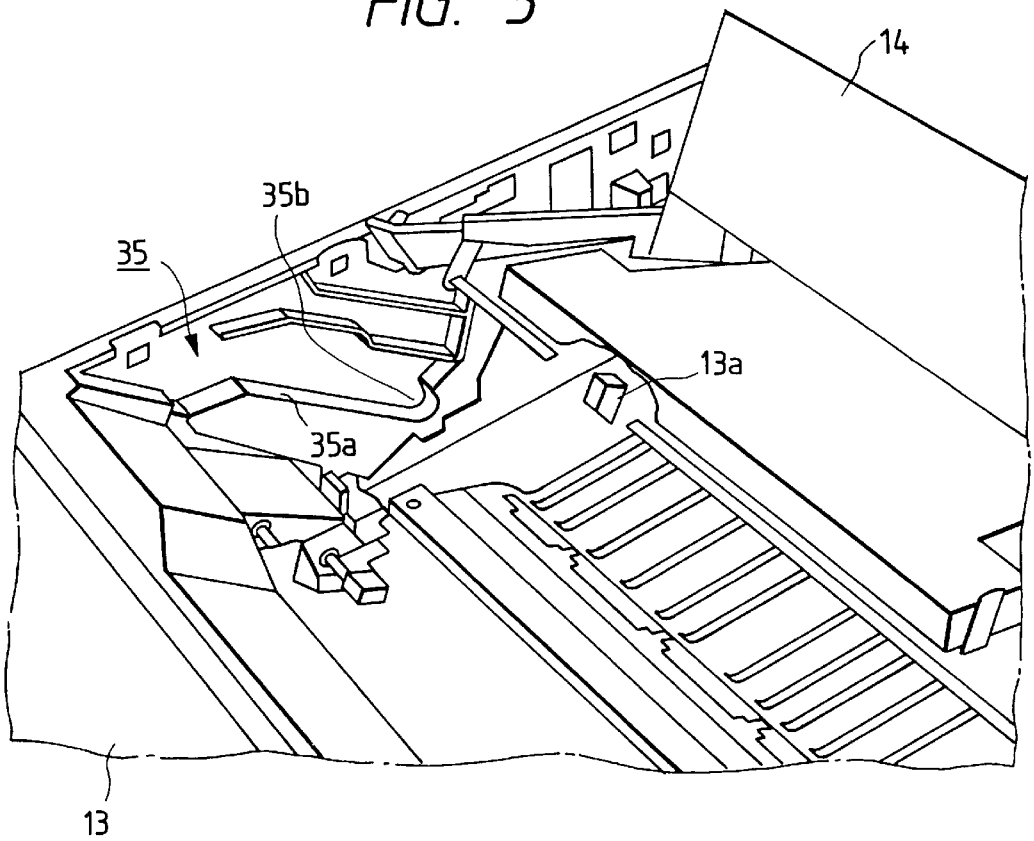
FIG. 5 is a perspective view showing a left side of a cartridge mounting portion.
Figure 6:
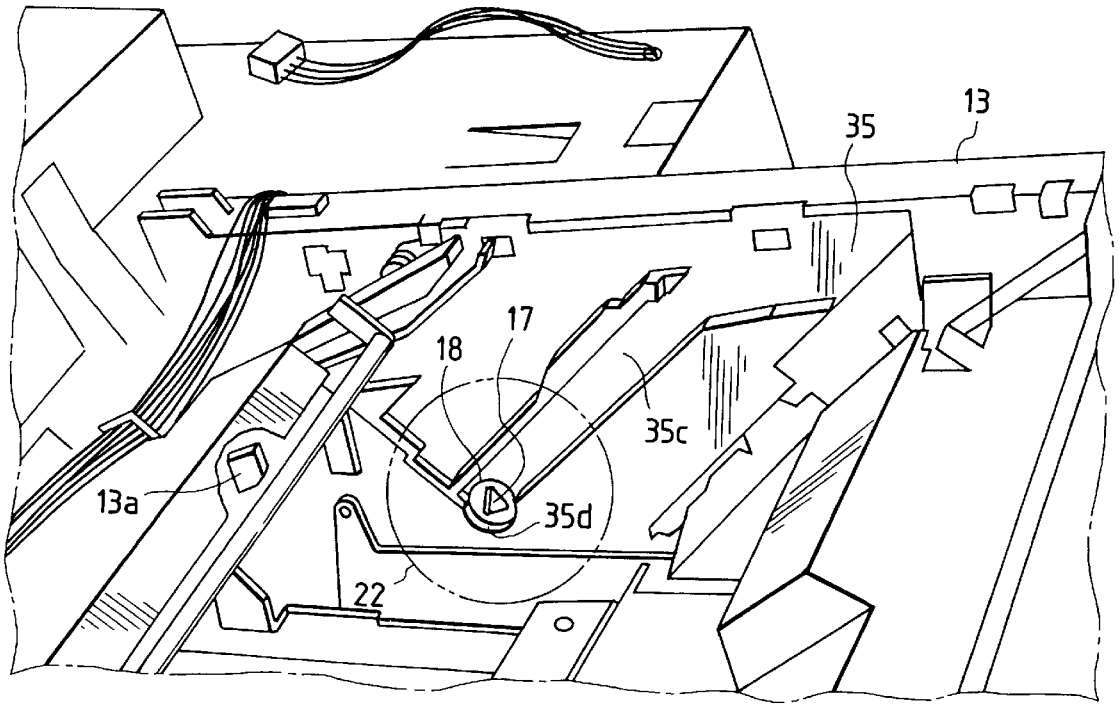
FIG. 6 is a perspective view showing a right side of a cartridge mounting portion.

The process cartridge B includes a developing unit obtained by welding (ultrasonic welding in the illustrated embodiment) a toner frame 12*a*, including the toner containing portion 10*a*, and a developing frame 12*b*, holding developing members such as the developing roller 10*d*, to each other. The developing unit is pivotally connected to a cleaning frame 12*c* supporting the photosensitive drum 7, charge roller 8 and cleaning means 11. The developing unit and the cleaning frame are biased toward one another around the connected point by a compression spring so that large diameter portions provided on both ends of the developing roller 10*d* are urged against the photosensitive drum 7. The operator can mount and dismount the process cartridge B with respect to a cartridge mounting means (which will be described later) of the main assembly 13 from a direction transverse to a longitudinal direction of the photosensitive drum 7 (FIGS. 5 and 6). The cleaning frame 12*c* is provided with a mounting guide 12*c*4 disposed in the vicinity of a bearing 12*c*2 for supporting a drum shaft 36*a* of the photosensitive drum 7, as shown in FIG. 4. Further, as shown in FIG. 3, a mounting guide 12*c*5 is integrally formed with a bearing 34 attached to the cleaning frame 12*c*. The mounting guides 12*c*4, 12*c*5 are guided by guide portions 35*a*, 35*c* (FIGS. 5 and 6) when the process cartridge B is mounted.

In the cartridge mounting means, as shown in FIG. 5, a pair of opposed cartridge mounting guide members 35 are formed on left and right side surfaces defining a cartridge mounting space within the main assembly 13 (one side surface is shown in FIG. 5 and the other side surface is shown in FIG. 6), and the left and right guide members 35 have opposed guide portions 35*a*, 35*c* which serve to guide the insertion of the process cartridge B. The process cartridge is inserted while a cylindrical boss 34*a* and bearing 12*c*2, protruded from both longitudinal end faces of the process cartridge and the mounting guides 12*c*4, 12*c*5, are being guided by the guide portions 35*a*, 35*c*. The cylindrical boss 34*a* is supported in a U-shaped recess 35*d* formed in the end of the guide portion 35*c* and the bearing 12*c*2 is fitted into a U-shaped recess 35*d* formed in the end of the guide portion 35*a*. Incidentally, after an opening/closing cover 14 (which can be opened with respect to the main assembly 13 around a shaft 14*a*) is opened, the process cartridge B is mounted to the main assembly 13. By closing the opening/closing cover 14, the mounting of the process cartridge B to the main assembly 13 of the image forming apparatus is completed. Incidentally, before the process cartridge B is dismounted from the main assembly 13, the opening/closing cover 14 is opened.

When the process cartridge B is mounted to the main assembly 13 of the image forming apparatus, as will be described later, in synchronism with the closing movement of the opening/closing cover 14, a cartridge side coupling member and a main assembly side coupling member are interconnected so that the photosensitive drum 7 and the like can be rotated by a driving force from the main assembly 13.

<Coupling and Drive Arrangement>

Next, the construction of a coupling as a driving force transmitting mechanism for transmitting a driving force from the main assembly 13 of the image forming apparatus to the process cartridge B will be explained.

Figure 7:
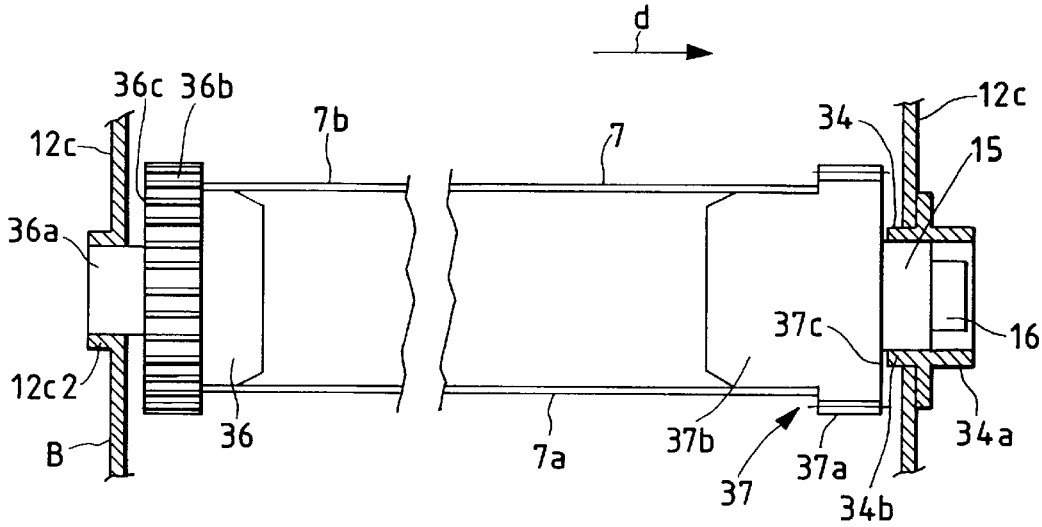
FIG. 7 is a longitudinal sectional view of a photosensitive drum.
Figure 8:
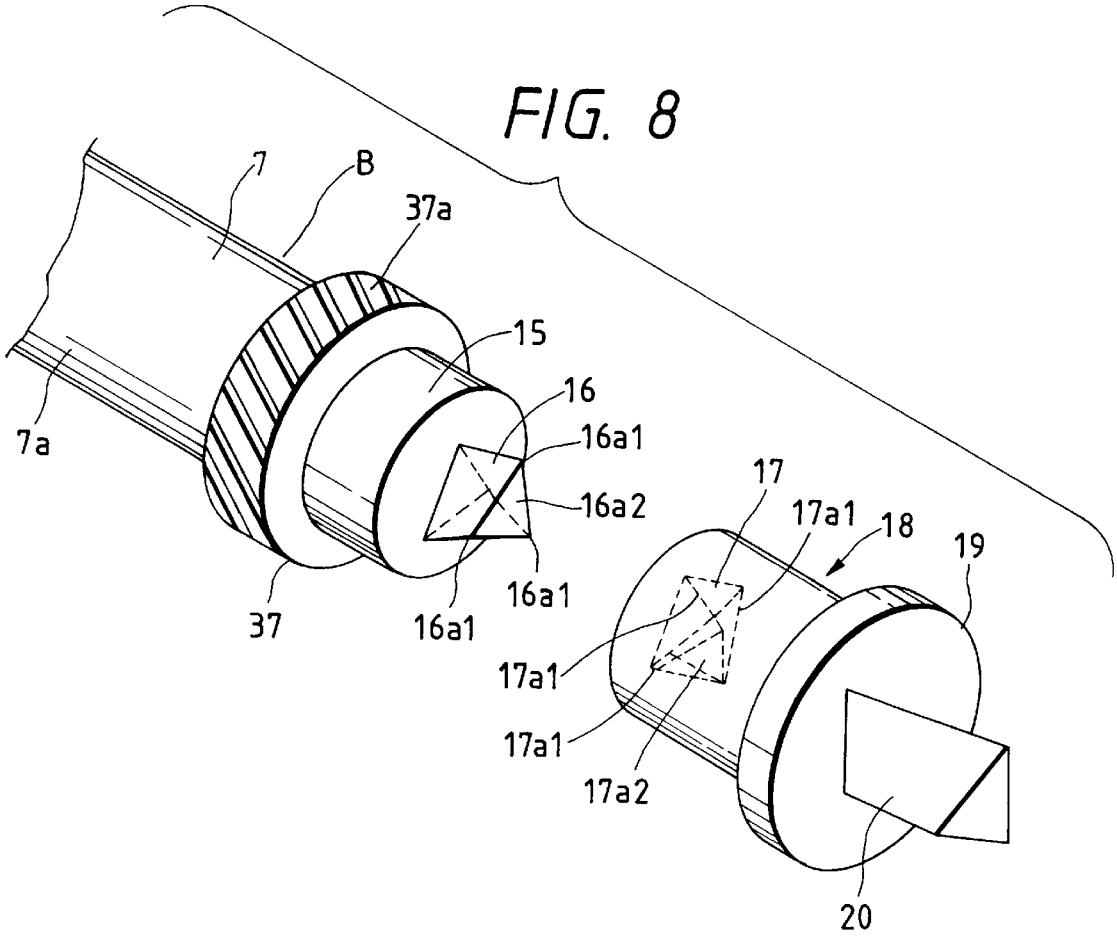
FIG. 8 is a perspective view of a shaft coupling.
Figure 9:
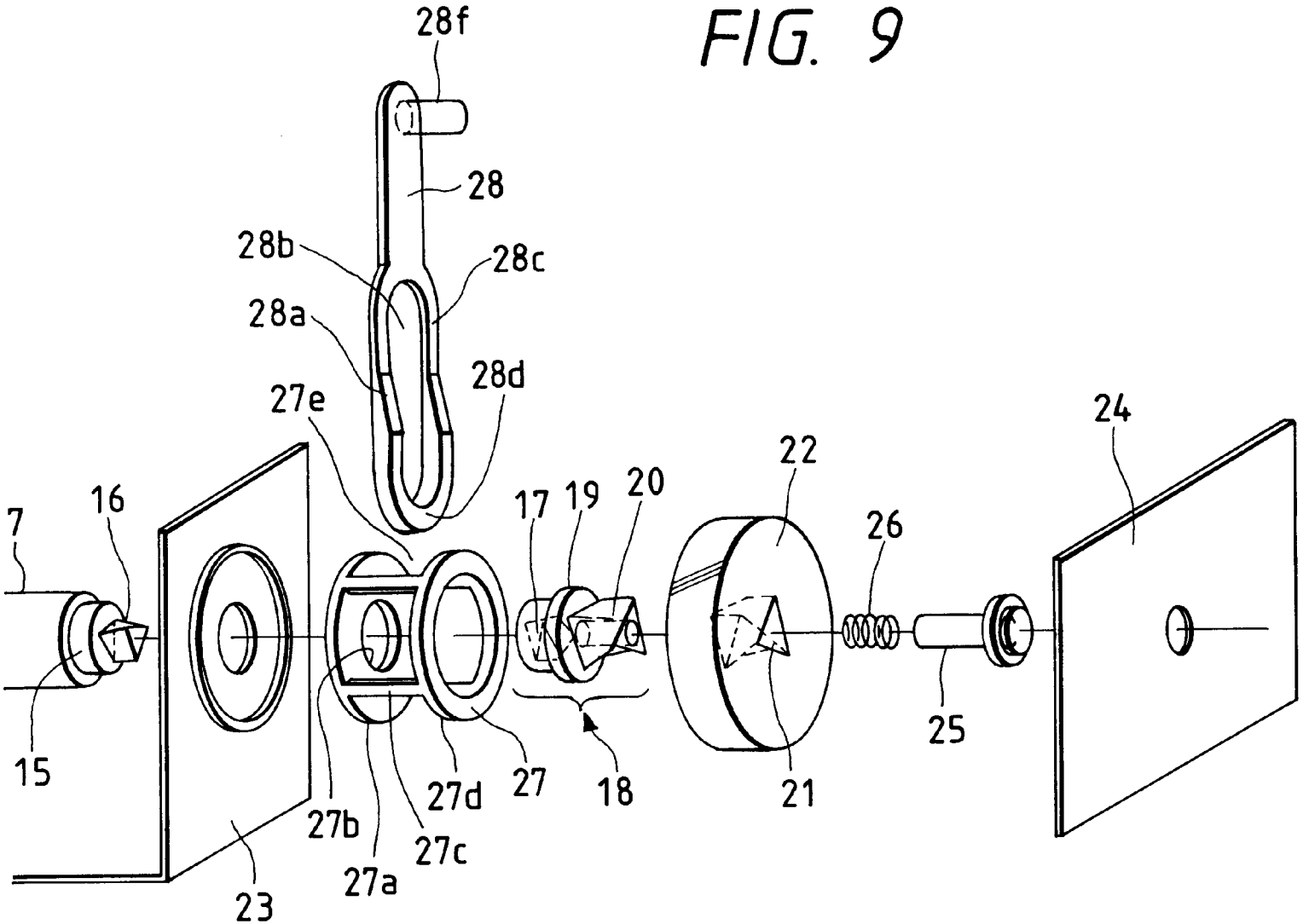
FIG. 9 is a perspective view for explaining a shaft coupling apparatus according to a first embodiment.

As shown in FIGS. 7, 8 and 9, a process cartridge side coupling member is provided on one longitudinal end of the photosensitive drum 7 included in the process cartridge B. This coupling member comprises a (cylindrical) coupling protruded shaft 15 (acting as a rotary shaft for the photosensitive drum 7), formed on a drum flange 37 secured to one end of the photosensitive drum 7, and a drum shaft projection 16 formed on an end face of the coupling protruded shaft 15. An end face of the projection 16 is parallel with the end face of the coupling protruded shaft 15. In the illustrated embodiment, the drum flange 37, the coupling protruded shaft 15 and the drum shaft projection 16 are formed integrally with each other.

As shown in FIG. 7, the coupling protruded shaft 15 and the drum shaft projection 16 are provided on the drum flange 37 so that they are aligned with the axis of the photosensitive drum 7 when the drum flange 37 is attached to one end of the photosensitive drum 7. A fitting portion 37*b* closely contacts an inner surface of a drum cylinder 37*a* when the drum flange 37 is attached to the photosensitive drum 7. The drum flange 37 is attached to the photosensitive drum 7 by caulking or adhesion. A photosensitive layer 7*b* is coated on an outer cylindrical surface of the drum cylinder 7*a* (see FIG. 7).

A drum flange 36 is secured to the other end of the photosensitive drum 7, and a drum shaft 36*a* and a spur gear 36*b* are integrally formed with the drum flange 36 (see FIG. 7).

When the process cartridge B is mounted to the main assembly 13, the bearing 12*c*2 is positioned within the U-shaped recess 35*b* (FIG. 5) of the main assembly 13 and the spur gear 36*b*, integral with the drum flange 36, is engaged by a gear (not shown) for transmitting a driving force to the transfer roller 4. Since the developing unit side is heavier than the cleaning frame 12*c* side with respect to the photosensitive drum 7, as shown in FIG. 1, an abutment portion 12*c*1 provided on the cleaning frame 12*c* abuts against an abutment portion 13*a* secured to the main assembly 13, and an upper surface of the developing unit is urged by a compression spring 14*b* disposed on an under surface of the opening/closing cover 14.

The drum flanges 37, 36 (shaft 15 and projection 16) are formed from material such as polyacetal, polycarbonate, polyamide or polybutylene terephthalate. However, other materials may be selected appropriately.

A cylindrical boss 34*a* formed on the cleaning frame 12*c* is positioned around the projection 16 of the coupling protruded shaft 15 and is coaxial with the coupling protruded shaft 15 (see FIGS. 3 and 7). The drum shaft projection 16 is protected by the boss 34*a* when the process cartridge B is mounted to and dismounted from the main assembly to thereby prevent damage and deformation of the projection 16 due to any external force. Thus, play and vibration can be prevented from occurring during the operation of the coupling due to the deformation of the drum shaft projection 16. The shape of the boss 34*a* is not limited to the cylindrical shape as illustrated in this embodiment, but may be semi-circular shape, for example, so long as the boss can be guided by the guide 35*c* and can be supported in the U-shaped recess 35*d*. In the illustrated embodiment, while an example that the cylindrical boss 34*a* is integrally formed with the bearing 34 for rotatably supporting the coupling protruded shaft 15 and the bearing is secured to the cleaning frame 12*c* by screws (not shown) (FIGS. 3 and 7) was explained, the boss 34*a* may be formed independently from the bearing 34.

Further, in the illustrated embodiment, the photosensitive drum 7 of the process cartridge B is attached to the cleaning frame 12*c* under a condition that the drum shaft 36*a* is fitted in the bearing 12*c*2 of the cleaning frame 12*c* (see FIGS. 4 and 7) and the coupling protruded shaft 15 is fitted into the bearing 34 attached to the cleaning frame 12*c*. Thus, the photosensitive drum 7 is rotated around the coupling shaft 15 and the drum shaft 36*a*. Incidentally, in the illustrated embodiment, as shown in FIG. 7, the photosensitive drum 7 is attached to the cleaning frame 12*c* for axial movement in consideration of attachment tolerance. However, the present invention is not limited to this, but, the photosensitive drum 7 may be attached to the cleaning frame 12*c* so that the photosensitive drum cannot be moved axially with respect to the cleaning frame. That is to say, it may be arranged so that an end face 37*c* of the drum flange 37 (end face of the spur gear 37*a*) is slidably contacted with an end face 34*b* of the bearing 34*a* and an end face 36*c* of the drum flange 36 is slidably contacted with the inner surface of the cleaning frame 12*c*.

As shown in FIG. 8, the projection 16 has a configuration of a twisted polygonal prism, and more particularly, it has a cross-section of a substantially equilateral triangle and is gradually twisted to change its angular phase in the axial direction. The corner portions of the prism are rounded. The coupling shaft recess 17 for engaging with the drum shaft projection 16 is constituted by a hole having a cross-section of polygonal shape gradually twisted to change its angular phase in the axial direction. The coupling shaft recess 17 is provided in one end of a coupling shaft 18. At the other end of the coupling shaft 18, a coupling shaft projection 20 comprised of a polygonal prism (more particularly, a substantially equilateral triangular prism having round corner portions) gradually twisted to change its angular phase in the axial direction with the same pitch is provided on a coupling shaft flange 19 and is coaxial with the coupling shaft recess 17. A gear side coupling recess 21 for engaging with the coupling shaft projection 20 is constituted by a hole having a cross-section of polygonal shape gradually twisted to change its angular phase in the axial direction and is formed in a center of a drum drive gear (main assembly side rotary member) 22. The gear side coupling recess (hole) 21 has a cross-section substantially of an equilateral triangle into which the coupling shaft projection 20 is just fitted. The gear side coupling recess 21 and the coupling shaft projection 20 may be constituted by female and male threaded portions having a large lead and are engaged with each other accurately.

A driving force from a drive motor (not shown) is transmitted to the drum drive gear 22 through a gear train (not shown), and the drum drive gear 22 transmits the driving force to the process cartridge B. The driving force is transmitted from the drum drive gear 22 to the coupling shaft 18 through the coupling comprised of the gear side coupling recess 21 formed in the center of the drum drive gear 22 and the coupling shaft projection 20. By fitting the drum shaft projection 16 into the coupling shaft recess 17 integral with the coupling shaft projection 20 with the interposition of the coupling shaft flange 19, the driving force is transmitted to the process cartridge B. In this way, the drum drive gear 22 is rotated integrally with the drum shaft projection 16 of the process cartridge B.

In the arrangement according to the illustrated embodiment, when the process cartridge B is mounted to the main assembly 13 and the drum drive gear 22, coupling shaft 18 and drum shaft projection 16 are fitted each other, the axes of these elements are aligned with each other so that the corner portions of the substantially triangular drum shaft projection 16 and the inner surface of the coupling shaft recess 17, and the corner portions of the coupling shaft projection 20 and the inner surface of the gear side coupling recess 21 are equally contacted, respectively. Due to the twisted configuration, the projections 16, 20 are pulled toward the recesses 17, 21 so that the end face of the drum shaft projection 16 abuts against the bottom of the coupling shaft recess 17. Thus, the photosensitive drum 7 integral with the drum shaft projection 16 is stably positioned within the main assembly 13 in axial and radial directions.

In the illustrated embodiment, viewed from the photosensitive drum 7 side, the twisted direction of the drum shaft projection 16 is opposite to the rotational direction of the photosensitive drum 7 from a root to a tip end of the drum shaft projection 16, and the twisted direction of the coupling shaft recess 17 is opposite to the rotational direction of the photosensitive drum 7 from its entrance to a bottom of the coupling shaft recess 17. Similarly, viewed from the photosensitive drum 7 side, the twisted direction of the coupling shaft projection 20 is opposite to the rotational direction of the photosensitive drum 7 from a root to a tip end of the coupling shaft projection 20, and the twisted direction of the gear side coupling recess 21 is opposite to the rotational direction of the photosensitive drum 7 from its entrance to a bottom of the gear side coupling recess 21.

Figure 11:
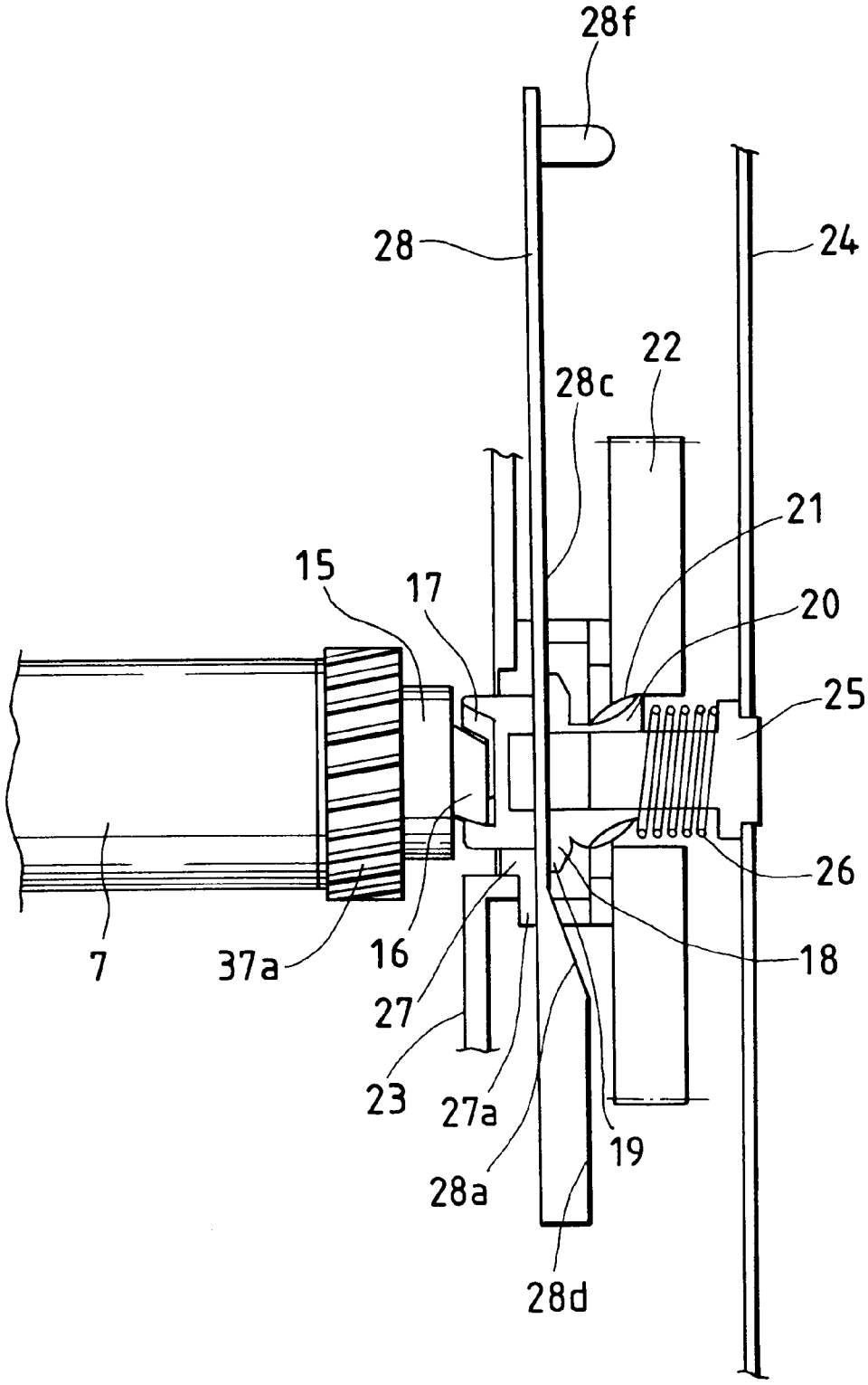
FIG. 11 is a sectional view for explaining the connection of the shaft coupling according to the first embodiment.

The main assembly 13 is provided with a main assembly coupling apparatus. The main assembly coupling apparatus includes the coupling shaft recess 17 disposed to be aligned with the axis of the photosensitive drum 7 when the process cartridge B is inserted into the main assembly. As shown in FIG. 11, the coupling shaft 18 is a drive shaft coupled to the drum drive gear 22 for transmitting the driving force of the drive motor (not shown) to the photosensitive drum 7.

Figure 10:
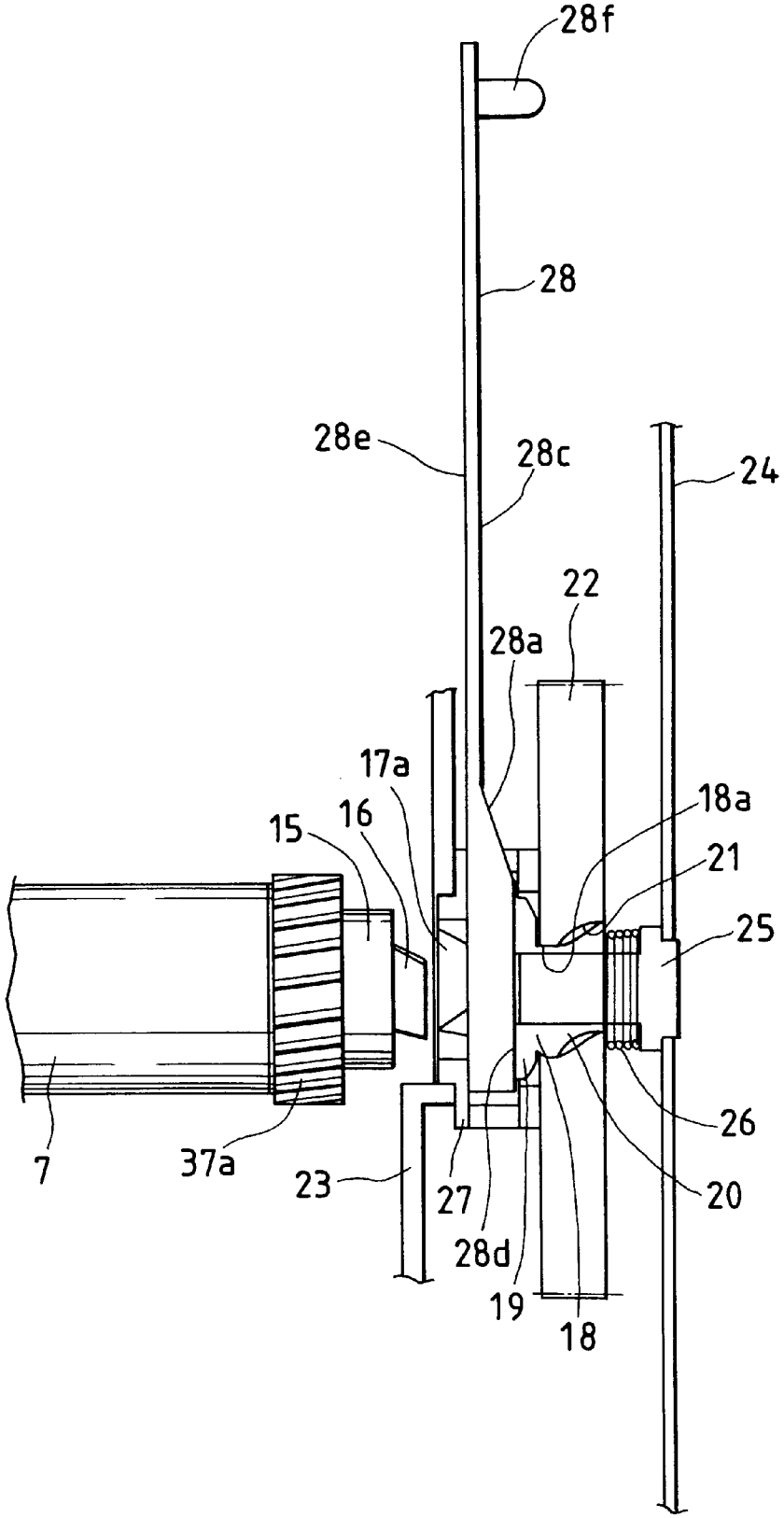
FIG. 10 is a sectional view for explaining the disconnection of the shaft coupling according to the first embodiment.

Next, an arrangement for effecting the engagement between the gear side coupling recess 21 and the coupling shaft projection 20 and the engagement between the coupling shaft recess 17 and the drum shaft projection 16 in synchronism with the closing movement of the opening/closing cover 14 will be explained with reference to FIGS. 9 to 11.

A coupling bearing 27 is secured to a main assembly frame 23 of the printer for defining a positioning portion for the process cartridge B and the driving system unit.

A compression coil spring 26 is mounted around a caulking shaft 25 at a root portion thereof in a compressed condition, which caulking shaft 25 is caulked into a driving metallic plate 24 to which a gear shaft (not shown) of the drive gear train is also caulked. The drive side coupling shaft projection 20 having the twisted prism of substantially triangular cross-section is slidably fitted on the caulking shaft 25 adjacent to the compression coil spring 26. And, the coupling shaft 18 having a coupling shaft recess hole 17*a* into which the drum shaft projection 16 having the twisted triangular prism of substantially triangular cross-section is fitted is rotatably supported on the photosensitive drum 7.

The drum drive gear (helical gear) 22 adapted to transmit the rotational driving force from the drive motor (not shown) to the photosensitive drum 7 and being provided at its center with the gear side coupling recess 21 into which the drive side coupling shaft projection 20 having the twisted triangular prism of substantially triangular cross-section is slid while being twisted is slidably contacted with an end face of a coupling bearing 27.

The coupling bearing 27 has a flange portion 27*a* fixedly supported by the main assembly frame 23, and the flange portion 27*a* is provided at its center with a radial bearing portion 27*b* for supporting rotatably and slidably the cylindrical outer periphery of the recess 17 of the coupling shaft 18 for sliding movement relative to the longitudinal direction of the photosensitive drum 7. The radial bearing portion 27*b* guides the coupling shaft 18 when the coupling shaft 18 is fitted onto the drum shaft projection 16 through the main assembly frame 23. Cross members 27*c* are protruded laterally from the flange portion 27*a* to provide at least upper and lower openings, and a thrust bearing portion 27*d* for supporting the thrust surface of the drum drive gear 22 is integrally formed with the other ends of the cross members 27*c*. A cam lever 28 is inserted into the upper opening 27*e* between the cross members 27*c* from the above.

The cam lever 28 constitutes a means for shifting the coupling shaft 18 relative to the longitudinal direction of the photosensitive drum 7, and the coupling shaft 18 passes through an elongated slot 28*b* defined by a cam surface comprised of an upper low vertical surface 28*c*, a lower high vertical surface 28*d* and a sloped surface 28*a* between the upper and lower surfaces 28*c* and 28*d* of the cam lever 28 passing through the upper and lower openings 27*e* of the coupling bearing 27. The cam lever 28 is disposed so that the side surface of the flange 19 of the coupling shaft 18 biased toward the photosensitive drum 7 by the compression coil spring 26 is contacted with the sloped surface 28*a*, low surface 28*c* or high surface 28*d*. The other surface of the cam lever 28 opposed to the sloped surface 28*a* is entirely constituted by a vertical surface 28*e* slidably contacted with the flange portion 27*a* of the coupling bearing 27. The cam lever 28 is guided by a vertical guide (not shown) secured to the main assembly 13. A pin 28*f* provided on the upper portion of the cam lever 28 is connected to one end of a link (not shown) having the other end pivotally connected to the opening/closing cover 14 pivotally connected to the main assembly 13 via the shaft 14*a*. Alternatively, the cam lever 28 may be guided vertically between the cross members 27*c*.

In the image forming apparatus A in which the rotational driving force from the main assembly 13 is transmitted to the detachable process cartridge B through the coupling, a condition that the coupling is released before the process cartridge B is inserted will be explained with reference to FIG. 10.

The drum drive gear 22 is connected to the drive motor (not shown) through the gear train (not shown) and is also connected to the gear train (not shown) for the sheet supply/convey system. The cam lever 28 is moved vertically in synchronism with the opening/closing movement of the opening/closing cover 14 for opening and closing the cartridge mounting portion for the process cartridge B.

Firstly, when the process cartridge B is mounted to the main assembly 13, the opening/closing cover 14 of the main assembly 13 has been opened. As shown in FIG. 10, the cam lever 28 disposed between the coupling bearing 27 and the coupling shaft 18 was positioned in an elevated position where the high surface 28*d* of the cam surface contacts the coupling shaft flange 19 to compress the compression coil spring 26. Thus, in the position at which the process cartridge B is positioned within the main assembly 13, the coupling shaft 18 is retracted from the main assembly frame 23 toward the drive side not to interfere with the mounting of the process cartridge B.

Secondly, when the process cartridge B was mounted to the main assembly 13 and was positioned in the guide members 15 secured to the main assembly frame 23, the opening/closing cover 14 can be closed.

When the opening/closing cover 14 is closed, as shown in FIG. 11, the cam lever 28 disposed between the coupling bearing 27 and the coupling shaft 18 is lowered in synchronism with the closing movement of the opening/closing cover 14, so that the high surface 28*d* and its opposite surface (28*e*) are lowered while sliding on the coupling shaft flange 19 and the flange portion 27*a* of the coupling bearing 27, respectively. When the sloped surface 28*a* contacts the coupling shaft flange 19, the coupling shaft 18 is shifted toward the photosensitive drum 7 by the spring force of the compression coil spring 26. When the cam lever 28 is lowered to the extent that the coupling shaft flange 19 contacts the low surface 28*c* of the cam surface, the position of the coupling shaft 18 is stabilized. As a result, the drive side coupling shaft recess 17 is urged against the drum shaft projection 16 of the process cartridge B mounted within the main assembly 13.

In the case, the drum drive gear 22 is not rotated since it is connected to the gear trains (not shown) driving the roller shafts on which the load acts respectively. Thus, the coupling shaft 18 is slid while the triangular prism of the drum drive gear 22 is being rotating along the twisted recess 21.

In this case, since both the drum shaft projection 16 and the coupling shaft recess 17 have triangular configurations, the coupling (16, 17) may not be coupled due to the phase difference.

In such a case, when the driving force is given to the drum drive gear 22 to output the image, the coupling shaft 18 biased toward the photosensitive drum 7 by the spring force of the compression coil spring 26 is urged toward the drum shaft projection 16, so that the coupling (16, 17) is coupled when the phases of the triangular configurations are aligned with each other. Since the coupling comprises the combination of the twisted triangular projection and hole, when the rotation is generated, the drum shaft projection 16 is pulled into the recess 17 of the coupling shaft 18. The process cartridge B is coupled to the coupling of the drive transmitting system of the main assembly 13 to thereby permitting the transmission of the driving force.

The above embodiments are summarized as follows.

Figure 14A:
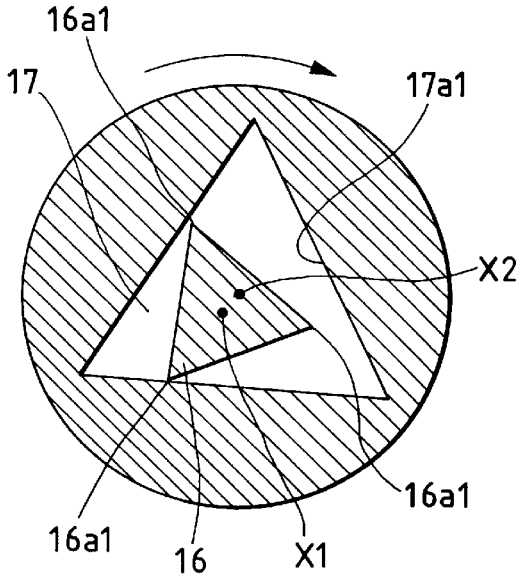
FIGS. 14A and 14B are views showing a connecting relation between a protruded portion and a recessed portion.
Figure 14B:
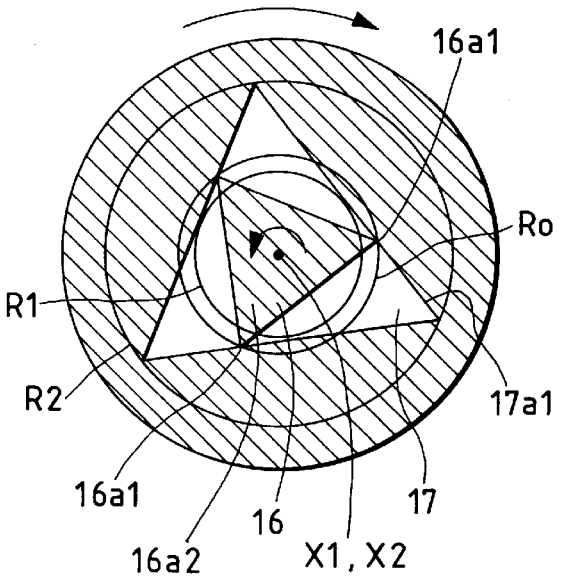

The projection 16 has the configuration of a twisted prism, and more particularly, it has a cross-section substantially of an equilateral triangle, and is gradually twisted to a small extent in the axial direction. The corner portion of the prism is rounded. The recess 17 for engaging with the projection 16 has a cross-section of polygonal shape, and is gradually twisted to a small extent in the axial direction. The projection 16 and the recess 17 are twisted in the same direction with the same twisting pitch. The section of the recess 17 is of a substantially triangular shape in this embodiment. The recess 17 is provided in a female coupling shaft 18 which is integral with a gear 22 in the main assembly 14 of the apparatus. The female coupling shaft 18 is rotatable and movable in the axial direction relative to the main assembly 14 of the apparatus. With this structure of this example, when the process cartridge B is mounted to the main assembly 14 of the apparatus, the projection 16 enters the recess 17 provided in the main assembly 14 (refer to FIG. 14A). When the recess 17 starts to rotate, the recess 17 and the projection 16 are brought into engagement with each other. When the rotating force of recess 17 is transmitted to the projection 16, the edge lines 16*a*1 of the substantially equilateral triangle projection 16 and the inner surfaces 17*a*1 of the recess 17, uniformly contact each other, and therefore, the axes are aligned (refer to FIG. 14B). To accomplish this, the diameter of the circumscribed circle R0 of the male coupling projection 16 is larger than that of the inscribed circle R1 of the female coupling recess 17, and is smaller than that of the circumscribed circle R2 of the female coupling recess 17. The twisting produces such a force that projection 16 is pulled toward the recess 17, so that end surface of the projection 16*a*2 is abutted to the bottom 17*a*2 of the recess 17. Thus, a thrust force is produced to urge the drum gear 37*a* in the direction of an arrow d, and therefore, the photosensitive drum 7 integral with the projection 16 is stably positioned in the main assembly 14 of the image forming apparatus both in the axial direction and in the radial direction.

In this example, the twisting direction of the projection 16 is opposite from the rotational direction of the photosensitive durm 7 in the direction from the bottom trunk of the projection 16 toward the free end thereof, as seen from the photosensitive drum 7; the twisting direction of the recess 17 is opposite in the direction from the inlet of the recess 17 toward the inside; and the twisting direction of the drum gear 37*a* of the drum flange 37 is opposite from the twisting direction of the projection 16.

The male shaft 18 and the projection 17 are provided on the drum flange 37 such that when the drum flange 37 is mounted to end of the photosensitive drum 7, they are coaxial with the axis of the photosensitive drum 7. Designated by 37*b* is an engaging portion which is engaged with the inner surface of the drum cylinder 7*d* when the drum flange 37 is mounted to the photosensitive drum 7. The drum flange 37 is mounted to the photosensitive drum 7 by crimping or bonding. The circumference of the drum cylinder 7*a* is coated with a photosensitive layer 7*b*.

As described hereinbefore, the process cartridge B of this embodiment comprises:

a process cartridge detachably mountable to a main assembly of an forming apparatus 14, wherein said main assembly includes a motor (not shown), a main assembly side gear 22 for receiving a driving force from the motor and a hole 17 defined by twisted surfaces, the hole 17 being substantially coaxial with the gear 22; an electrophotographic photosensitive drum 7;

process means (8, 10, 11) actable on the photosensitive drum 7; and a twisted projection 16 engageable with the twisted surfaces, said projection 16 being provided at a longitudinal end of the photosensitive drum 7, wherein when the main assembly side gear 22 rotates with the hole 17 and projection 16 engaged with each other, a rotational driving force is transmitted from the gear 22 to the photosensitive drum 7 through engagement between the hole 17 and the projection 16.

The twisted projection 16 is provided at a longitudinal end of the photosensitive drum 7, and has a non-circular cross-section and is substantially coaxial with a rotation axis of the photosensitive drum 7, wherein the projection 16 of the photosensitive drum 7 has such a dimension and configuration that it can take a first relative rotational position with respect to a recess 17 of the driving rotatable member (main assembly side gear 22) in which relative rotational movement therebetween is permitted, and a second relative rotational position with respect to the recess 17 of the driving rotatable member in which relative rotational movement is prevented in one rotational direction, while the rotation axis of the driving rotatable member and the rotation axis of the photosensitive drum 7 are substantially aligned.

Thirdly, an operation for dismounting the process cartridge B from the main assembly 13 for replacement of the process cartridge B or the jam treatment (sheet jam treatment) will be explained.

In order to dismount the process cartridge B from the main assembly 13, the coupling of the coupling mechanism must be released. The recess 17 formed in the coupling shaft 18 is twisted to pull the drum shaft projection 16 into the recess 17 during the drive rotation. Thus, in the coupling mechanism, the drum shaft projection 16 screwed into the recess 17 can smoothly be released by rotating the coupling shaft 18 in a direction opposite to the rotational driving direction.

In the illustrated embodiment, before the process cartridge B is dismounted, the opening/closing cover 14 for covering the cartridge mounting portion is opened. Consequently, in synchronism with the opening movement of the opening/closing cover 14, the cam lever 28 is lifted, so that the coupling shaft flange 19 contacts the cam surface (low surface 28*c*, sloped surface 28*a* and high surface 28*d*) of the cam lever is urged by the sloped surface 28*a* in opposition to the spring force of the compression coil spring 26 to retract the coupling shaft 18 toward the drum drive gear 22, thereby compressing the compression coil spring 26.

In this case, since the drum drive gear 22 is supported not to be shifted in the axial direction and is connected to gear trains (not shown) on which the load acts respectively, the drum drive gear cannot be rotated easily. Thus, the coupling shaft 18 is slid toward the driving plate 24 to be threaded into the center of the drum drive gear 22 while the triangular prism of the drum drive gear 22 is being rotated along the threaded portion of the twisted gear side coupling recess 21 in a direction opposite to the driving direction. That is to say, since the coupling shaft 18 is threaded-in in the direction opposite to the driving direction, the coupling between the drum shaft projection 16 and the coupling shaft recess 17 is released by merely opening the opening/closing cover 14. Since the coupling shaft 18 is retarded to the position retracted from the main assembly frame 23 toward the drive side, the process cartridge B can be dismounted without performing other operation.

According to the illustrated embodiment, when the twisted angle at the contact portion between the drum shaft projection 16 and the coupling shaft recess 17 is selected to be equal to the twisted angle at the contact portion between the coupling shaft projection 20 and the gear side coupling recess 21, during the releasing of the coupling, the following operation can be realized. That is, even if the resistance of the gear train connected to the drum drive gear 22 is great and the rotation resistance of the photosensitive drum 7 and the resistance of the gear train connected to the helical gear 37*a* are also great, the coupling shaft 18 can be shifted from the photosensitive drum 7 side to the driving plate 24 side without moving the drum drive gear 22 and the photosensitive drum 7. Thus, the load acting on the opening/closing cover 14 when the latter is opened becomes small.

Accordingly, the twisted angles of the threaded portions of the drum shaft projection 16, the coupling shaft recess 17, the coupling shaft projection 20 and the gear side coupling recess 21 can be made greater (larger twist). When the twisted angles are selected to be larger, the photosensitive drum 7 can be attracted greatly in the axial direction to thereby ensure the axial positioning of the photosensitive drum 7. Further, since the drum drive gear 22 is not moved in the axial direction, the space occupied by the coupling apparatus within the main assembly 13 is small, to thereby make the main assembly 13 more compact.

Second Embodiment

Next, a second embodiment of the present invention will be explained with reference to FIG. 12. Incidentally, since the fundamental constructions of the process cartridge B and the electrophotographic image forming apparatus A are the same as those in the first embodiment, the same elements as those in the first embodiment are designated by the same reference numerals and an explanation thereof will be omitted.

Figure 12:
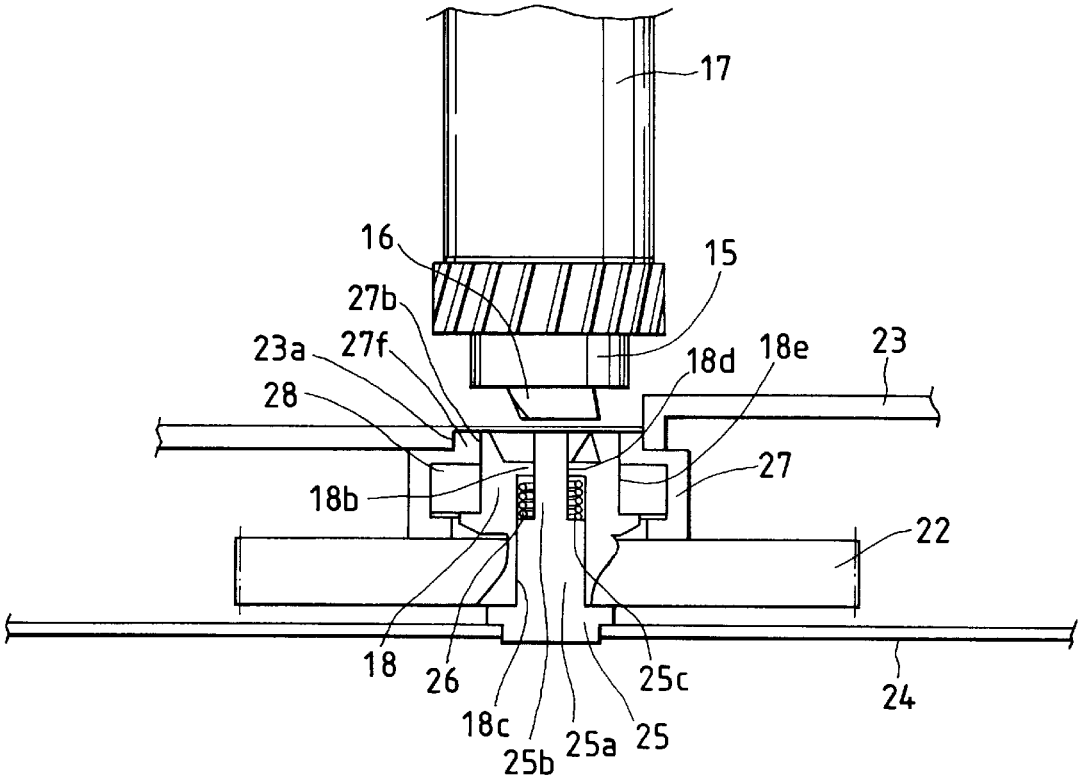
FIG. 12 is a sectional view for explaining a coupling mechanism according to a second embodiment.

FIG. 12 is a sectional view for explaining a main assembly 13, process cartridge B and coupling apparatus.

The (stepped) caulking shaft 25 caulked to the driving metallic plate 24 has a large diameter shaft portion 25*a* and a small diameter shaft portion 25*b* which are coaxial with each other. The large diameter shaft portion 25*a* is fitted into a large diameter cylindrical hole 18*c* formed in the coupling shaft 18. The small diameter shaft portion 25*b* of the stepped caulking shaft 25 is fitted into a small diameter cylindrical hole 18*d* formed in the coupling shaft 18 near the photosensitive drum 7, and the positioning of the coupling shaft 18 in the X-Y direction (direction perpendicular to the axial direction) is effected by fitting the shaft into the large diameter shaft portion 25*a* and small diameter shaft portion 25*b* within a long range in the longitudinal direction.

The compression coil spring 26 for biasing the coupling shaft 18 toward the photosensitive drum 7 is fitted onto small diameter shaft portion 25*b* of the stepped caulking shaft 25 so that one end of the compression coil spring 26 abuts against a shoulder 25*c* defined between the large diameter shaft portion 25*a* and the small diameter shaft portion 25*b* of the stepped caulking shaft 25. The other end of the compression coil spring 26 is urged by a thrust flange portion 18*b* formed in the interior of the coupling shaft 18 so that the coil spring can be compressed. A drum side cylindrical shaft portion 18*e* of the coupling shaft 18 coaxial with the large diameter cylindrical hole 18*c* and the small diameter cylindrical hole 18*d* formed in the coupling shaft 18 is fitted into a radial bearing portion 27*a* of the coupling bearing 27.

A shaft portion 27*f* of the coupling bearing 27 coaxial with the radial bearing portion 27*a* of the coupling bearing 27 is fitted into a positioning reference hole 23*a* formed in the main assembly frame 23. Accordingly, the driving metallic plate 24 and the main assembly frame 23 are fitted and positioned around the centers of the coupling members.

The caulking shaft 25 is positioned in the rotational direction by fitting other caulking shafts (not shown) caulked to the driving metallic plate 24 into other elongated holes (not shown) formed in the main assembly frame 23.

As mentioned above, when the driving metallic plate 24 to which the caulking shafts (not shown) as rotary shafts of the gear trains (not shown) is attached and secured to the main assembly frame 23, by using the stepped caulking shaft 25 as the positioning reference in the X-Y plane for the main assembly frame 23 and the driving metallic plate 24, the driving system can be positioned around the axis of the drum with high accuracy by using the coupling apparatus.

Third Embodiment

Next, another embodiment of a coupling apparatus as a driving force transmitting mechanism for transmitting a driving force from the main assembly 13 of the image forming apparatus to the process cartridge B will be explained with reference to FIG. 9. The same elements as those in the first embodiment are designated by the same reference numerals and an explanation thereof will be omitted.

The drum shaft projection (photosensitive drum side coupling shaft) 16 having the twisted triangular prism fitted and secured to the photosensitive drum 7 is formed from conductive material.

The drum shaft projection 16 is electrically connected to the aluminium drum cylinder 7*a* by forming the entire drum flange 37 (FIG. 8) from conductive plastic. The caulking shaft 25 caulked to the driving metallic plate 24 (formed from iron, for example) is formed from metallic material (for example, iron). The coupling shaft 18 fitted onto the caulking shaft 25 for sliding movement in the thrust direction and the coupling shaft projection 20 comprised of the twisted triangular prism (near the driving metallic plate 24) and the coupling shaft recess 17 fitted onto the drum shaft projection 16 comprised of the twisted triangular prism (near the photosensitive drum 7) is formed from conductive resin. The reference numeral 22 denotes a drum drive gear to transmit a driving force from a drive motor (not shown) to the photosensitive drum 7 and having a central drum drive gear recess 21 through which the coupling shaft projection 20, comprised of the twisted triangular prism of the coupling shaft 18, is slid while being twisted; and 26 denotes a compression coil spring formed from conductive material (for example, spring steel) to always bias the coupling shaft 18 toward the photosensitive drum 7. That is to say, although the mechanism has the same construction as that of the first embodiment, constructural elements thereof are formed from materials different from these in the first embodiment so that the electrical connection is established between the drum cylinder 7*a* and the driving metallic plate 24.

As described in connection with the operation of the first embodiment, when the drive motor (not shown) is driven, the coupling shaft 18 is urged against the drum shaft projection 16 of the process cartridge B mounted within the main assembly 13, so that the conductive coupling shaft 18 abuts against the drum shaft projection 16 of the photosensitive drum 7. Accordingly, the charges charged (by friction between the recording medium and the drum) on the metallic member holding the photosensitive layer of the photosensitive drum 7 can be grounded through the conductive drum shaft projection 16, the conductive coupling shaft 18, the metallic compression coil spring 26, the metallic caulking shaft 25 and the driving metallic plate 24.

Fourth Embodiment

Next, a further embodiment of a coupling apparatus as a driving force transmitting mechanism for transmitting a driving force from the main assembly 13 of the image forming apparatus to the process cartridge B will be explained. The same elements as those in the aforementioned embodiments are designated by the same reference numerals and an explanation thereof will be omitted.

Figure 13:
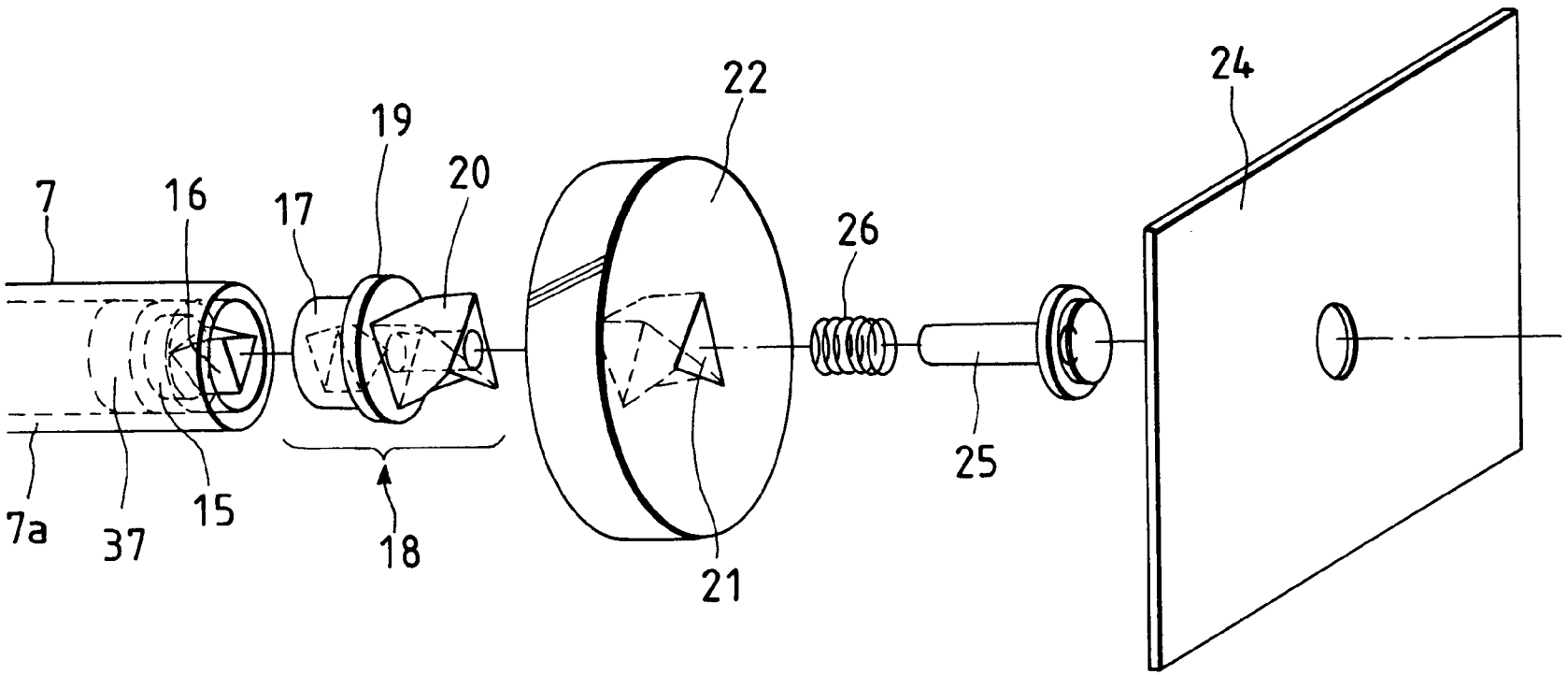
FIG. 13. is a perspective view for explaining a coupling mechanism according to a fourth embodiment.

As shown in FIG. 13, a cartridge side coupling member is provided on one longitudinal end of the photosensitive drum 7 attached to the process cartridge B. The cartridge side coupling member is constituted by a drum shaft projection 16 provided on a drum flange 37 secured to one end of the photosensitive drum 7. A drum shaft 15 on which the drum shaft projection 16 is formed acts as a drum rotary shaft. The drive side of the photosensitive drum is supported by supporting the drum shaft 15 by an extension of a bearing 24 or by directly supporting the periphery of the end of the photosensitive drum 7 by the bearing 24. In the illustrated embodiment, the drum shaft projection 16 is formed integrally with the drum flange 37 and is disposed within the interior of the hollow drum cylinder 7*a* of the photosensitive drum 7.

The drum shaft projection 16 has a configuration of a twisted prism, and more particularly, it has a cross-section substantially of equilateral triangle and is gradually twisted to a small extent in the axial direction. The coupling shaft recess 17 for engaging with the drum shaft projection 16 has a cross-section of polygonal shape and is gradually twisted to a small extent in the axial direction. The coupling shaft recess 17 is provided in one end of a coupling shaft 18. At the other end of the coupling shaft 18, a coupling shaft projection 20 comprised of a polygonal prism (more particularly, substantially equilateral triangular prism) twisted in the same direction with the same pitch is provided on a coupling shaft flange 19 and is coaxial with the coupling shaft recess 17.

A driving force from a drive motor (not shown) is transmitted to a drum drive gear 22 through a gear train (not shown), and the drum drive gear 22 transmits the driving force to the process cartridge B. The driving force is transmitted from the drum drive gear 22 to the coupling shaft 18 through the coupling comprised of a gear side coupling recess 21 formed in the center of the drum drive gear 22 and the coupling shaft projection 20 of the coupling shaft 18. By fitting the drum shaft projection 16 into the coupling shaft recess 17 integral with the coupling shaft projection 20 with the interposition of the coupling shaft flange 19, the driving force is transmitted to the process cartridge B.

In this way, the drum drive gear 22 is rotated integrally with the drum shaft of the process cartridge B. In this case, the coupling shaft recess 17 of the coupling shaft 18 is shifted to the interior of the photosensitive drum 7 together with the drum shaft projection 16 of the photosensitive drum 7.

In the above arrangement, when the photosensitive drum 7 is rotated, since the triangular drum shaft projection 16 is fitted into the triangular coupling shaft recess 17 with clearance, the axes are positioned in a direction perpendicular to the axial direction by the self-centering action. In this case, the axis of the driven side of the photosensitive drum 7 is positioned by mounting and supporting the process cartridge B in the cartridge mounting portion of the main assembly 13, and, at the drive side of the photosensitive drum, the photosensitive drum 7 is floatingly supported with respect to the cartridge frame or the cartridge frame is floatingly supported with respect to the main assembly.

In the illustrated embodiment, while an example that the engagement and disengagement between the coupling shaft and the drum shaft is effected by engaging and disengaging the drum shaft projection 16 of the photosensitive drum 7 with respect to the recess 17 of the coupling shaft, so long as the twisted angle and the twisted direction are the same, a twisted hole having a polygonal cross-section may be formed in the drum shaft, and a twisted polygonal prism for engaging the hole may be provided on the coupling shaft 18.

The twisted hole formed in the center of the drum drive gear 22 and the twisted coupling projection 20 are not limited to the polygonal cross-section, but may be a pair or spiral splines. Further, a twisted projection may be provided on the center of the drum drive gear 22 and a twisted hole may be formed in the coupling shaft.

In the above-mentioned embodiments, while an example that the compression coil spring is used for biasing the coupling shaft 18 in the axial direction was explained, a plurality of coned compression disc springs laminated in the axial direction may be used.

According to the above-mentioned embodiments, since the coupling is constituted by the twisted hole and the twisted polygonal prism having a polygonal cross-section, the rotation accuracy of the drive transmission can be improved, and thus, the rotation accuracy of the electrophotographic photosensitive drum is improved.

Further, according to the above-mentioned embodiments, the driving force can be positively transmitted from the main assembly to the electrophotographic photosensitive drum. When the driving force is transmitted (during the image formation), the rotation center of the coupling member provided on the main assembly can be substantially aligned with the rotation center of the coupling member provided on the electrophotographic photosensitive drum.

According to the above-mentioned embodiments, when the driving force is transmitted (during the image formation), the positioning accuracy of the electrophotographic photosensitive drum and accordingly the process cartridge with respect to the main assembly can be improved by attracting the electrophotographic photosensitive drum toward the main assembly. When the driving force is not transmitted (when the opening/closing cover is opened during non-image formation), the coupling between the main assembly of the image forming apparatus and the process cartridge is disconnected, so that the dismounting operability of the process cartridge from the main assembly of the image forming apparatus can be improved.

According to the above-mentioned embodiments, since the coupling shaft having a small diameter is shifted in the thrust direction, there is no need for providing a large space for movement of a rotary member (for example, large diameter gear) to thereby make the entire image forming apparatus more compact. By arranging the spring for biasing the coupling member within the coupling shaft, the entire image forming apparatus is made further compact. Further, when the process cartridge is dismounted, i.e., when the coupling is disconnected, since the drive gear at the main assembly side is not rotated, a large load is not generated. Thus, the operability is improved.

Since the coupling shaft shifting means is disposed with a shifting range of the coupling shaft, there is no need for providing the installation space for the shifting means to thereby make the main assembly of the image forming apparatus more compact (i.e., reducing the length of the main assembly). Further, since the thrust bearing member for positioning the rotary member in the thrust direction is formed integrally with the radial bearing member for the coupling shaft, the assembling operability can be improved.

When the coupling is disconnected, there is no need for providing a mechanism for releasing the driving force transmitting apparatus, the number of parts is reduced, and productivity is improved. A plurality of gear trains can be directly connected to the rotary member, so that the total number of gears can be reduced. Thus, the apparatus is made compact and cheaper.

Since the center of the coupling shaft is aligned with the center of the electrophotographic photosensitive drum, when the driving force transmitting apparatus of the main assembly of the image forming apparatus is formed as a unit, the positioning accuracy of such a unit can be improved. Further, since the fitting area between the electrophotographic photosensitive drum and the coupling shaft is disposed within the drum cylinder holding the photosensitive layer of the electrophotographic photosensitive drum, the dimension of the electrophotographic photosensitive drum in the thrust direction can be reduced.

By forming the coupling member press-fitted in the electrophotographic photosensitive drum and the coupling member of the main assembly of the image forming apparatus (coupling shaft) from conductive resin or metal, the charges charged on the electrophotographic photosensitive drum can surely be grounded.

As mentioned above, according to the present invention, the releasing operability of the coupling can be improved.

What is claimed is:

1. An electrophotographic image forming apparatus which forms an image on a recording medium and to which a process cartridge can detachably be mounted, comprising:

(a) a cartridge mounting portion capable of detachably mounting said process cartridge including an electrophotographic photosensitive drum, process means acting on said electrophotographic photosensitive drum, and a projection having a first-twisted-polygonal prism shape at one longitudinal end of said electrophotographic photosensitive drum;

(b) a rotatable rotary member having a first twisted hole of polygonal cross-section;

(c) a rotatable coupling shaft supported for axial movement, one end of which has a second-twisted-polygonal prism shape and is fitted into said first twisted hole of said rotary member, said coupling shaft being provided at its other end with a second twisted hole of polygonal cross-section for engaging with and disengaging from said projection having the first-twisted-polygonal prism shape and having substantially the same twisted angle and twisted direction of those of said one end having the first-twisted-polygonal prism shape;

(d) a spring member for biasing said coupling shaft toward said electrophotographic photosensitive drum;

(e) axial direction shifting means for shifting said second twisted hole and said projection having the first-twisted-polygonal prism shape relative to each other between a first position where said second twisted hole of said coupling shaft is disengaged from said projection having the first-twisted-polygonal prism shape of said electrophotographic photosensitive drum, and a second position where said second twisted hole of said coupling shaft is engaged with said projection, having the first-twisted-polygonal prism shape, of said electrophotographic photosensitive drum; and (f) convey means for conveying the recording medium.

2. An electrophotographic image forming apparatus which forms an image on a recording medium and to which a process cartridge can detachably be mounted, comprising:

(a) a cartridge mounting portion capable of detachably mounting said process cartridge including an electrophotographic photosensitive drum, process means acting on said electrophotographic photosensitive drum, and a projection having a first-twisted-polygonal prism shape at one longitudinal end of said electrophotographic photosensitive drum;

(b) a rotatable rotary member having a first twisted hole of polygonal cross-section;

(c) a rotatable coupling shaft supported for axial movement, one end of which has a second-twisted-polygonal prism shape and is fitted into said first twisted hole of said rotary member, said coupling shaft member being provided at its other end with a second twisted hole of polygonal cross-section for engaging with and disengaging from said projection having the first-twisted-polygonal prism shape and having substantially the same twisted angle and twisted direction as those of said one end having the twisted polygonal prism shape;

(d) a spring member for biasing said coupling shaft toward said electrophotographic photosensitive drum;

(e) axial direction shifting means for shifting said second twisted hole and said projection having the first-twisted-polygonal prism shape relative to each other between a first position where said second twisted hole of said coupling shaft is disengaged from said projection, having the first-twisted-polygonal prism shape, of said electrophotographic photosensitive drum, and a second position where said second twisted hole of said coupling shaft is engaged with said projection, having the first-twisted-polygonal prism shape, of said electrophotographic photosensitive drum;

(f) a coupling bearing integrally including a flange portion having a radial bearing for receiving the outer periphery of the other end of said coupling shaft having said second twisted hole for rotational movement and axial shifting movement, a thrust bearing portion for rotatably supporting said rotary member not to be shifted toward said electrophotographic photosensitive drum, and an opening portion provided between said flange portion and said thrust bearing portion for inserting said shifting means for shifting said coupling shaft; and (g) convey means for conveying the recording medium.

3. An electrophotographic image forming apparatus which forms an image on a recording medium and to which a process cartridge can detachably be mounted, comprising:

(a) a cartridge mounting portion capable of detachably mounting said process cartridge including an electrophotographic photosensitive drum, process means acting on said electrophotographic photosensitive drum, and a projection having a first-twisted-polygonal prism shape at one longitudinal end of said electrophotographic photosensitive drum;

(b) a rotatable rotary member having a first twisted hole of polygonal cross-section;

(c) a rotatable coupling shaft supported for axial movement, one end of which has a second-twisted-polygonal prism shape and is fitted into said first twisted hole of said rotary member, said coupling shaft being provided at its other end with a second twisted hole of polygonal cross-section for engaging with and disengaging from said projection having the first-twisted-polygonal prism shape and having substantially the same twisted angle and twisted direction as those of said one end having the twisted-polygonal prism shape, said coupling shaft being further provided with a flange positioned between said one end and said other end thereof;

(d) a spring member for biasing said coupling shaft toward said electrophotographic photosensitive drum;

(e) an opening/closing member provided at said cartridge mounting portion;

(f) a coupling bearing integrally including a flange portion having a radial bearing for receiving the outer periphery of the other end of said coupling shaft having said second twisted hole for rotational movement and axial shifting movement, a thrust bearing portion for rotatably supporting said rotary member not to be shifted toward said electrophotographic photosensitive drum, and an opening portion provided between said flange portion and said thrust bearing portion for inserting a cam lever;

(g) a cam member having a cam disposed between said flange portion of said coupling bearing and said flange of said coupling shaft and operable in synchronism with opening/closing movement of said opening/closing member; and (h) convey means for conveying the recording medium.

4. An electrophotographic image forming apparatus according to claim 1, 2 or 3, wherein said rotary member is a helical gear.

5. An electrophotographic image forming apparatus according to claim 1, 2 or 3, wherein said coupling shaft has a stepped bore fitted onto coaxial large diameter and small diameter portions of a stepped caulking shaft caulked to a side plate for supporting a member for transmitting a driving force to said rotary member, said spring member being fitted on said small diameter portion of said stepped caulking shaft so that one end of said spring member abuts against a shoulder defined between said large diameter and small diameter portions of said stepped caulking shaft, and the other end of said spring member abuts against a thrust direction flange portion formed within said coupling shaft and fitted onto said small diameter portion of said stepped caulking shaft to thereby permit compression of said spring member.

6. An electrophotographic image forming apparatus according to claim 1, 2 or 3, wherein said twisted holes have a substantially triangular-shaped cross-section and said projection has the configuration of a twisted triangular prism, and wherein corner portions of said triangular prism are rounded.

7. An electrophotographic image forming apparatus according to claim 1 or 2, further comprising an opening/closing member opened before said process cartridge is mounted to said cartridge mounting portion and closed after said process cartridge is mounted to said cartridge mounting portion, and cooperating means for driving said shifting means in synchronism with the opening/closing movement of said opening/closing member.

8. An electrophotographic image forming apparatus which forms an image on a recording medium and to which a process cartridge can detachably be mounted, comprising:

(a) a cartridge mounting portion capable of detachably mounting said process cartridge including an electrophotographic photosensitive drum, process means acting on said electrophotographic photosensitive drum, and a first twisted hole of polygonal cross-section provided in one longitudinal end of said electrophotographic photosensitive drum;

(b) a rotatable rotary member having a second twisted hole of polygonal cross-section;

(c) a rotatable coupling shaft supported for axial movement, one end of which has a first-twisted-polygonal prism shape and is fitted into said second twisted hole of said rotary member, the other end of said coupling shaft having a second-twisted-polygonal prism shape for engaging with and disengaging from said first twisted hole of said electrophotographic photosensitive drum and having substantially the same twisted angle and twisted direction as those of said one end having the first-twisted-polygonal prism shape;

(d) a spring member for biasing said coupling shaft toward said electrophotographic photosensitive drum;

(e) axial direction shifting means for shifting said first twisted hole and said other end having the second-twisted-polygonal prism shape relative to each other between a first position where said other end, having the second-twisted-polygonal prism shape, of said coupling shaft is disengaged from said first twisted hole of said electrophotographic photosensitive drum by opening an opening/closing member, and a second position where said other end, having the second-twisted-polygonal prism shape; of said coupling shaft is engaged with said first twisted hole of said electrophotographic photosensitive drum by closing said opening/closing member; and (f) convey means for conveying the recording medium.

9. An electrophotographic image forming apparatus according to claim 1, 2, 3 or 8, further comprising a side plate for supporting a main assembly frame and a member for transmitting a driving force to said rotary member in a spaced relation thereto, and wherein said coupling shaft is positioned in a plane perpendicular to the axial direction thereof by fitting said coupling shaft onto a caulking shaft caulked to said side plate and by rotatably supporting said coupling shaft by said main assembly frame.

10. An electrophotographic image forming apparatus according to claim 1, 2, 3 or 8, wherein said coupling shaft, and a drum flange portion having a coupling portion connectable to said coupling shaft and fitted on said electrophotographic photosensitive drum, are formed from conductive material.

11. An electrophotographic image forming apparatus according to claim 1, 2, 3 or 8, wherein said electrophotographic photosensitive drum is formed from a hollow member and wherein said projection or said hole of said electrophotographic photosensitive drum is disposed within the hollow interior of said electrophotographic photosensitive drum.

12. A process cartridge detachably mountable to a main assembly of an electrophotographic image forming apparatus having a rotatable coupling shaft supported for axial movement, one end of which has a first-twisted-polygonal prism shape fitted into a first twisted hole formed in a rotary member, and being provided at its other end with a second twisted hole of polygonal cross-section having substantially the same twisted angle and twisted direction as said one end having the first-twisted-polygonal prism shape, said process cartridge comprising:

an electrophotographic photosensitive drum;

process means acting on said electrophotographic photosensitive drum; and a projection provided on one longitudinal end of said electrophotographic photosensitive drum having a second-twisted-polygonal prism shape and fitted into said second twisted hole of polygonal cross-section of said coupling shaft;

wherein after the process cartridge is mounted to the main assembly of said electrophotographic image forming apparatus, when said rotary member is rotated under a condition that the longitudinal end of said projection having the second-twisted-polygonal prism shape is fitted into said second twisted hole of polygonal cross-section of said coupling shaft, said projection is pulled toward said second twisted hole of polygonal cross-section of said coupling shaft to transmit a rotational force of said rotary member to said electrophotographic photosensitive drum, and, when said coupling shaft is retarded from said electrophotographic photosensitive drum, said coupling shaft is retarded while being twisted not to apply a rotational force to said electrophotographic photosensitive drum.

13. A process cartridge detachably mountable to a main assembly of an electrophotographic image forming apparatus having a rotatable coupling shaft supported for axial movement, one end of which has a first-twisted-polygonal prism shape and is fitted into a first twisted hole formed in a rotary member, and the other end of which has a second-twisted-polygonal prism shape having substantially the same twisted angle and twisted direction as those of said one end having the first-twisted-polygonal prism shape, said process cartridge comprising:

an electrophotographic photosensitive drum;

process means acting on said electrophotographic photosensitive drum; and a second twisted hole of polygonal cross-section provided in one longitudinal end of said electrophotographic photosensitive drum and fitted onto said other end of said coupling shaft having the second-twisted-polygonal prism shape;

wherein after the process cartridge is mounted to the main assembly of said electrophotographic image forming apparatus, when said rotary member is rotated in a condition that said other end of said coupling shaft having the second-twisted-polygonal prism shape is fitted into said second twisted hole of polygonal cross-section of said electrophotographic photosensitive drum, said second twisted hole of said electrophotographic photosensitive drum is pulled toward said other end of said coupling shaft having the second-twisted-polygonal prism shape to transmit a rotational force of said rotary member to said electrophotographic photosensitive drum, and, when said coupling shaft is retarded from said electrophotographic photosensitive drum, said coupling shaft is retarded while being twisted not to apply a rotational force to said electrophotographic photosensitive drum.

14. A process cartridge according to claim 12 or 13, wherein the process means includes charge means, developing means, or cleaning means.

15. A process cartridge according to claim 12 or 13, wherein the process means includes at least one of charge means, developing means and cleaning means.

16. A process cartridge according to claim 12 of 13, wherein said twisted holes have a substantially triangular cross-section and said projection has a twisted triangular prism whose corner portions are rounded.

17. An electrophotographic image forming apparatus for forming an image on a recording material, comprising:

(a) an electrophotographic photosensitive drum;

(b) charging means for charging said photosensitive drum;

(c) developing means for developing a latent image formed on said photosensitive drum into a toner image;

(d) transfer means for transferring the toner image onto the recording material;

(e) fixing means for fixing the toner image on the recording material;

(f) a motor;

(g) a driving rotatable member for receiving a driving force from said motor;

(h) a first twisted hole substantially coaxial with said driving rotatable member, said hole having a polygonal cross-section;

(i) a first twisted prism projection provided at a longitudinal end of said photosensitive drum;

(j) a rotatable coupling shaft supported for axial movement and being provided at its one end with a second twisted prism projection to be fitted into said first twisted hole of said driving rotatable member, said coupling shaft being provided at its the other end with a second twisted hole for engaging with/disengaging from said first twisted prism projection, said hole having a polygonal cross-section; and (k) moving means for imparting an axial movement to said coupling shaft;

wherein, when said driving rotatable member is rotated, a rotational driving force is transmitted from said driving rotatable member to said photosensitive drum through engagement between first twisted hole and said second twisted prism projection, and engagement between said second twisted hole and said first twisted prism projection.

18. An electrophotographic image forming apparatus, for forming an image on a recording material, to which a process cartridge is detachably mountable, said image forming apparatus comprising:

(a) a motor;

(b) a driving rotatable member for receiving a driving force from said motor;

(c) a first twisted hole substantially coaxial with said driving rotatable member, said hole having a polygonal cross-section;

(d) means for detachably mounting a process cartridge, the process cartridge including:
(i) an electrophotographic photosensitive drum;
(ii) process means actable on said photosensitive drum;
(iii) a first twisted prism projection provided at a longitudinal end of said photosensitive drum;
(iv) a rotatable coupling shaft supported for axial movement and being provided at its one end with a second twisted prism projection to be fitted into said first twisted hole of said driving rotatable member, said coupling shaft being provided at its the other end with a second twisted hole for engaging with/disengaging from said first twisted prism projection, said hole having a polygonal cross-section; and
(v) moving means for imparting an axial movement to said coupling shaft; and (e) means for feeding the recording material, wherein, when said driving rotatable member is rotated, a rotational driving force is transmitted from said driving rotatable member to said photosensitive drum through engagement between said first twisted hole and said second twisted prism projection and engagement between said second twisted hole and said first twisted prism projection.

19. An electrophotographic image forming apparatus according to claim 17 or 18, further comprising a spring member for biasing said coupling shaft toward said electrophotographic photosensitive drum.

20. An electrophotographic image forming apparatus according to claim 17 or 18, wherein said first twisted hole and said second twisted prism projection have substantially the same twisted angle and twisted direction.

21. An electrophotographic image forming apparatus according to claim 17 or 18, wherein said second twisted hole and said first twisted prism projection have substantially the same twisted angle and twisted direction.

22. An electrophotographic image forming apparatus according to claim 17 or 18, wherein said first twisted hole has a substantially triangular cross section.

23. An electrophotographic image forming apparatus according to claim 17 or 18, wherein said first twisted prism projection is a substantially triangular pole.

24. An electrophotographic image forming apparatus according to claim 17 or 18, wherein said coupling shaft moves axially thereof, corresponding to opening operation of an open/close member provided in a main body of said image forming apparatus.

25. An electrophotographic image forming apparatus for forming an image on a recording material, comprising:

(a) an electrophotographic photosensitive drum;

(b) charging means for charging said photosensitive drum;

(c) developing means for developing a latent image formed on said photosensitive drum into a toner image;

(d) transfer means for transferring the toner image onto the recording material;

(e) fixing means for fixing the toner image on the recording material;

(f) a motor;

(g) a driving rotatable member for receiving a driving force from said motor;

(h) a first hole substantially coaxial with said driving rotatable member;

(i) a first projection provided at a longitudinal end of said photosensitive drum;

(j) a rotatable coupling shaft supported for axial movement and being provided at its one end with a second projection to be fitted into said first hole of said driving rotatable member, said coupling shaft being provided at its other end with a second hole for engaging with/disengaging from said first projection; and (k) moving means for imparting an axial movement to said coupling shaft;
wherein, when said driving rotatable member is rotated, a rotational driving force is transmitted from said driving rotatable member to said photosensitive drum through engagement between said first hole and said second projection, and engagement between said second hole and said first projection.

26. An electrophotographic image forming apparatus, or forming an image on a recording material, to which a process cartridge is detachably mountable, said image forming apparatus comprising:

(a) a motor;

(b) a driving rotatable member for receiving a driving force from said motor;

(c) a first hole substantially coaxial with said driving rotatable member;

(d) means for detachably mounting a process cartridge, the process cartridge including:
(i) an electrophotographic photosensitive drum;
(ii) process means actable on said photosensitive drum;
(iii) a first projection provided at a longitudinal end of said photosensitive drum;
(iv) a rotatable coupling shaft supported for axial movement and being provided at its one end with a second projection to be fitted into said first hole of said driving rotatable member, said coupling shaft being provided at its other end with a second hole for engaging with/disengaging from said first projection; and
(v) moving means for imparting an axial movement to said coupling shaft; and (e) means for feeding the recording material;
wherein, when said driving rotatable member is rotated , a rotational driving force is transmitted from said driving rotatable member to said photosensitive drum through engagement between said second hole and said first projection.

27. An electrophotographic image forming apparatus according to claim 25 or 26, further comprising a spring member for biasing said coupling shaft toward said electrophotographic photosensitive drum.

28. An electrophotographic image forming apparatus according to claim 25 or 26, wherein said coupling shaft moves axially thereof, corresponding to an opening operation of an open/close member provided in a main body of said image forming apparatus.

29. An electrophotographic image forming apparatus according to claim 18 or 26, wherein the process means includes at least one of charge means, developing means and cleaning means.

* * * * *

UNITED STATES PATENT AND TRADEMARK OFFICE

CERTIFICATE OF CORRECTION

PATENT NO. : 6,035,159

DATED : March 7, 2000

INVENTOR(S): Jun AZUMA, et al.

It is certified that error appears in the above-identified patent and that said Letters Patent is hereby corrected as shown below:

COLUMN 1:

Line 10, "includes" should read --include--.

COLUMN 2:

Line 3, "looked at" should read --viewed--.
Line 6, "looked at" should read --viewed--.
Line 33, "embodiment" should read --the embodiments--.

COLUMN 3:

Line 28, "the photosensitive drum is" should be deleted.
Line 29, "drum" should read --drum 7--.

COLUMN 4:

Line 21, "tridge" should read --tridge B--.
Line 23, "cartridge" should read --cartridge B--.

COLUMN 5:

Line 39, "shape," should read --in shape,--.

UNITED STATES PATENT AND TRADEMARK OFFICE

CERTIFICATE OF CORRECTION

PATENT NO. : 6,035,159

DATED : March 7, 2000

INVENTOR(S) : Jun AZUMA, et al.

It is certified that error appears in the above-identified patent and that said Letters Patent is hereby corrected as shown below:

COLUMN 6:

Line 46, "each" should read --to each--.

COLUMN 8:

Line 63, "In the case," should read --In this case,--.
Line 67, "rotating" should read --rotated--.

COLUMN 9:

Line 16, "permitting" should read --permit--.
Line 59, "durm" should read --drum--.

COLUMN 10:

Line 1, "end" should read --an end--.
Line 12, "an forming" should read --a forming--.
Line 17, "22; an" should read --22; ¶an--.
Line 61, "contacts" should read --which contacts--.

COLUMN 11:

Line 16, "other" should read --another--.
Line 35, "greater" should read --larger--.

UNITED STATES PATENT AND TRADEMARK OFFICE

CERTIFICATE OF CORRECTION

PATENT NO. : 6,035,159

DATED : March 7, 2000

INVENTOR(S): Jun AZUMA, et al.

It is certified that error appears in the above-identified patent and that said Letters Patent is hereby corrected as shown below:

COLUMN 12:

Line 27, "is attached" should read --are attached--.

COLUMN 14:

Line 33, "be a pair" should read --be a helix pair--.

COLUMN 20:

Line 18, "has a twisted" should read --has a configuration of a twisted--.
Line 44, "the other" should read --other--.
Line 53, "first" should read --said first--.

COLUMN 21:

Line 11, "its the other" should read --its other--.

UNITED STATES PATENT AND TRADEMARK OFFICE

CERTIFICATE OF CORRECTION

PATENT NO. : 6,035,159

DATED : March 7, 2000

INVENTOR(S): Jun AZUMA, et al.

It is certified that error appears in the above-identified patent and that said Letters Patent is hereby corrected as shown below:

COLUMN 22:

Line 18, "or" should read --for--.
Line 45, "rotated" should read --rotated,--.
Line 46, ",a" should read --a--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*